US012760986B1

(12) United States Patent
Lianqiang et al.

(10) Patent No.: US 12,760,986 B1
(45) Date of Patent: Oct. 13, 2026

(54) AIRGUN WITH PRESSURIZED CHAMBER

(71) Applicant: Umarex USA, Inc., Fort Smith, AR (US)

(72) Inventors: Wang Lianqiang, Qidong (CN); Liu Yaoyi, Qidong (CN)

(73) Assignee: UMAREX USA, INC., Fort Smith, AR (US)

( * ) Notice: Subject to any disclaimer, the term of this patent is extended or adjusted under 35 U.S.C. 154(b) by 0 days.

(21) Appl. No.: 19/468,931

(22) Filed: Feb. 3, 2026

(30) Foreign Application Priority Data

| | | |
|---|---|---|
| Apr. 22, 2025 | (CN) | 202510504133.0 |
| Apr. 22, 2025 | (CN) | 202520761986.8 |
| Apr. 22, 2025 | (CN) | 202520761989.1 |
| Apr. 22, 2025 | (CN) | 202520761992.3 |
| Apr. 22, 2025 | (CN) | 202520761993.8 |

(51) Int. Cl.

| | |
|---|---|
| ***F41B 11/62*** | (2013.01) |
| ***F41B 11/56*** | (2013.01) |
| ***F41B 11/721*** | (2013.01) |
| ***F41B 11/73*** | (2013.01) |

(52) U.S. Cl.
CPC ..... *F41B 11/62* (2013.01); *F41B 11/56* (2013.01); *F41B 11/721* (2013.01); *F41B 11/73* (2013.01)

(58) Field of Classification Search
CPC ..... F41B 11/62; F41B 11/56; F41B 11/721; F41B 11/73; F41B 11/00; F41B 11/50; F41B 11/51; F41B 11/60
USPC ..... 124/74
See application file for complete search history.

(56) References Cited

U.S. PATENT DOCUMENTS

| | | | | |
|---|---|---|---|---|
| 3,204,625 | A * | 9/1965 | Shepherd | F41B 11/62 124/31 |
| 10,801,805 | B1 * | 10/2020 | Hu | F41B 11/724 |
| 2003/0051717 | A1 * | 3/2003 | Hubert | F41B 11/721 124/71 |
| 2007/0181116 | A1 * | 8/2007 | Wei | F41B 11/723 124/74 |
| 2017/0153081 | A1 * | 6/2017 | Hu | F41B 11/721 |

(Continued)

FOREIGN PATENT DOCUMENTS

| | | | | |
|---|---|---|---|---|
| CA | 2249829 C | * | 12/2001 | F41B 11/56 |
| CN | 100380089 C | * | 4/2008 | G07F 19/201 |

(Continued)

*Primary Examiner* — John Cooper
(74) *Attorney, Agent, or Firm* — Mark A. Pitchford; Eric B. Fugett; Pitchford Fugett, PLLC

(57) ABSTRACT

Aspects of the invention provide a pressurization structure for an airgun having an inner barrel 4 sequentially connected at its rear end to a coaxially aligned hop-up rubber 6 which is connected to a cylinder 7. The hop-up rubber 6 is provided with a through cavity for projectile 516 with protrusions extending radially from the inner wall of the cavity to press against the projectile 516. The cylinder 7 has a chamber connected to the cavity, wherein a rubber piston 8 is installed, forming a sealed space between the rear of the projectile 516 and the chamber interior. A cut-off valve 9 is arranged within this sealed space. The cylinder 7 is connected to a magazine 14 that supplies propellant gas and projectiles 516 into the chamber. When pressurized gas is released from the magazine 14, the pressurization within the chamber enables higher initial kinetic energy of the projectile 516.

11 Claims, 21 Drawing Sheets

(56) References Cited

U.S. PATENT DOCUMENTS

| | | | | |
|---|---|---|---|---|
| 2020/0025510 | A1* | 1/2020 | Sandgren | F41A 33/06 |
| 2025/0044055 | A1* | 2/2025 | Liao | F41A 21/12 |

FOREIGN PATENT DOCUMENTS

| | | | | |
|---|---|---|---|---|
| DE | 102010015209 | B4 * | 11/2014 | F41B 11/62 |
| JP | 2003322495 | A * | 11/2003 | F41B 11/56 |

* cited by examiner

AIRGUN WITH PRESSURIZED CHAMBER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCE TO RELATED APPLICATIONS

This Application claims priority to Chinese Patent Application No. CN202510504133.0 entitled "A HIGH-RANGE AND HIGH-PRECISION PNEUMATIC AIR GUN" filed Apr. 22, 2025. This Application claims priority to Chinese Patent Application No. CN202520761986.8 entitled "HIGH-PRECISION, LONG RANGE PNEUMATIC AIRGUN SYSTEM" filed on Apr. 22, 2025. This Application claims priority to Chinese Patent Application No. CN202520761989.1 entitled "HOP-UP CHAMBER FOR AIRGUNS" filed on Apr. 22, 2025. This Application claims priority to Chinese Patent Application No. CN202520761993.8 entitled "CHAMBER PRESSURE BOOSTER FOR AIRGUNS" filed on Apr. 22, 2025. This Application claims priority to Chinese Patent Application No. CN202520761992.3 entitled "CO2 MAGAZINE DESIGN FOR AIRGUNS" filed on Apr. 22, 2025.

FEDERALLY SPONSORED RESEARCH AND DEVELOPMENT

Not Applicable

BACKGROUND OF THE INVENTION

The utility patent relates to the technical field of airguns, and specifically to a pressurization structure for an airgun chamber.

In the technical field of airguns, the operational mechanisms of conventional airgun structures are widely recognized. During the firing sequence, gas stored in the magazine 14 is released upon trigger actuation, flows into the cylinder 7, and is then directed by the cylinder 7 into the inner barrel 4 to propel the projectile 516 forward, thereby completing the firing action. Currently, such cylinder structures, by virtue of their stability and efficiency, have been extensively adopted in various airgun products. Under conditions of normal hardware specification matching and common usage scenarios, they can maintain relatively ideal performance.

However, when an airgun is equipped with a shorter inner barrel 4, the insufficient internal volume of the barrel causes the projectile 516 to exit the muzzle before the compressed gas has fully expanded. This prevents the gas energy from being completely converted into the kinetic energy of the projectile 516, resulting in insufficient muzzle kinetic energy. Consequently, the firing stability is compromised, inducing ballistic deviation, shortening the effective range, and failing to meet the required shooting accuracy.

In the field of air guns, pneumatic guns powered by liquid $CO_2$ ($CO_2$) are widely used. In existing technologies, such air guns operate by utilizing the vaporization and expansion of liquid $CO_2$, which then acts on the cylinder and the projectile to achieve the firing function. However, this process has significant drawbacks. Due to the short duration of the working cycle, it is common for the liquid $CO_2$ to fail to fully vaporize before the energy transfer is completed.

This not only results in insufficient working pressure, but also causes the rapid release of liquid $CO_2$ stored in the gas canister. At the same time, the magazine quickly cools down due to the rapid vaporization. The sharp drop in the magazine's temperature severely affects the stability of the working cycle, making it difficult to ensure consistent performance of the air gun as a whole.

SUMMARY OF THE INVENTION

Aspects of the present invention provide a long range and high accuracy pneumatic air gun.

A long range and high accuracy pneumatic air gun comprises a gun body, a grip, a trigger, a slide, and a firing mechanism that cooperates interactively with the trigger. A hop-up chamber is arranged inside the gun body, with the front end of the hop-up chamber connected to a inner barrel and the rear end connected to an cylinder. A magazine is arranged inside the grip. A hop-up rubber is arranged inside the hop-up chamber, and an adjustment assembly is also provided within the hop-up chamber for adjusting the tightness of the hop-up rubber. The cylinder includes a chamber that communicates with the inner cavity of the hop-up rubber. A gas-cutoff valve is slidably arranged within the chamber. The gas-cutoff valve has a rod portion and a head portion. The rod portion can slide axially within the cylinder, and the head portion is connected to one end of the rod. The head portion slides to block or open the front end of the chamber. A rubber piston is also installed at the rear end of the chamber to provide a seal. A gas supply route is arranged inside the magazine. This gas supply route has an gas inlet end and an gas outlet end that communicates with the chamber of the cylinder. Along the path between the gas inlet and gas outlet ends, an outlet valve and an inlet valve are provided. A secondary gas chamber is arranged within the gas supply route above the inlet valve. Further, a protrusion for pressing down the projectile is formed at the top of the inner side wall of the hop-up rubber. The adjustment assembly includes an adjustment ring and an adjustment dial. The adjustment ring is sleeved around the outer surface of the hop-up rubber, and the adjustment dial is used to control the movement of the adjustment ring, so as to tighten or loosen the hop-up rubber. Further, a rotating shaft is provided on the hop-up chamber, and the adjustment dial is mounted on the rotating shaft. An engagement groove is formed on the end face of the adjustment dial, and the adjustment ring includes a transmission component, which is slidably inserted into the engagement groove. Further, the inlet valve has a cylindrical tubular structure. The outer wall of the inlet valve fits tightly against the inner wall of the gas supply route, and a gas nozzle is recessed in the lower end surface of the inlet valve to communicate with the secondary gas chamber. Further, a gas canister is arranged inside the magazine, the gas outlet end of which is connected to a gas nozzle, and the interior of the gas canister is filled with liquid $CO_2$. Further, the magazine is provided with a projectile feeding channel for temporarily storing projectiles. A projectile-holding lip is also provided on the magazine. This holding lip includes a clamping lip capable of securing a single projectile. A projectile pushing rod is arranged below the cylinder to push the projectile from the clamping lip into the hop-up rubber. Further, a radially extending limiting block is formed on the outer wall of the hop-up rubber. A limiting slot is formed through the hop-up chamber, into which the limiting block is inserted to achieve secure positioning. Further, the rear end of the cylinder is sealed by a rubber piston, which includes a plug, a locking bolt, and a sealing ring. The plug is installed inside the rear end of the slide, and the locking bolt is mounted on the outer wall of the plug via the sealing ring. The outer surface of the sealing ring fits closely against the inner wall of the cylinder.

Aspects of the invention improve gas stability and energy efficiency by incorporating a large secondary gas chamber between the inlet valve and the outlet valve. This structure allows the liquid $CO_2$ gas from the gas bottle in the magazine to vaporize, expand, and stabilize in pressure within the secondary chamber. As a result, the gas released through the outlet valve is in a fully gaseous state. This design effectively enhances vaporization stability, ensuring that the gas is always in vapor form upon release. It reduces the cooling effect of liquid gas expansion on the entire magazine, stabilizes the internal pressure of the magazine, improves the working pressure, and ensures consistent output pressure. It also increases the effective utilization rate of liquid $CO_2$ gas. The resulting performance enhancement is significant: projectiles gain higher muzzle kinetic energy, and the fluctuation of muzzle energy between shots is reduced, leading to greater shooting accuracy. Additionally, with the same volume of commercially available gas canisters, more projectiles can be fired effectively, reducing gas consumption and operating cost.

Aspects of the invention utilize pre-chamber pressurization to allow the cylinder to store a certain amount of potential energy, which is then released instantaneously to convert the stored energy into kinetic energy for projectile launching. This cylinder pressurization mechanism significantly increases the kinetic energy of the projectile, enabling it to overcome the frictional resistance generated by the hop-up rubber. As a result, it effectively eliminates the problem of projectile jamming caused by excessive hop-up friction.

Aspects of the invention increase the kinetic energy of a projectile through pre-pressurization of the gas chamber and enlarges the contact area between the hop-up rubber and the projectile to apply greater friction, thereby achieving a stronger back spin effect that counteracts gravitational drop during long-distance flight, resulting in a more stable trajectory and The purpose of the utility patent is to provide a pressurization structure for an airgun chamber to solve the problems raised in the background technology.

Aspects of the present invention provide a pressurization structure for an airgun chamber, including an inner barrel 4, sequentially connected at its rear end to a coaxially disposed hop-up rubber 6 and a cylinder 7. The hop-up rubber 6 is penetrated by a cavity allowing projectile 516 sliding, with a protrusion extending radially along the inner wall of the cavity to compress the projectile 516. The cylinder 7 includes a chamber communicating with the cavity, wherein a rubber piston 8 is installed to form a sealed chamber behind the projectile 516; A cut-off valve 9 is disposed within the sealed chamber; A magazine 14 is externally connected to the cylinder 7 for supplying gas and projectiles 516 into the chamber. Further, the cut-off valve 9 is located inside the cylinder 7 and is capable of sliding axially along the cylinder 7. Further, the chamber is configured as a stepped bore structure, comprising a large-diameter end and a small-diameter end; the rubber piston 8 is disposed at the large-diameter end of the chamber, while the cut-off valve 9 slides within the small-diameter end. Further, the cut-off valve 9 includes a valve rod (41) slidably disposed within the small-diameter end, a plurality of valve vanes (42) are arranged on the outer wall of the valve rod (41), a valve head (43) is connected to the rear end of the valve rod (41), and gas passages (44) are formed between adjacent valve vanes (42) for gas flow. Further, each valve vane (42) extends radially from the valve rod (41), with its outer sidewall sealingly contacting the inner wall of the chamber; the plurality of valve vanes (42) are circumferentially arrayed around the outer wall of the valve rod (41). Further, an air inlet port is provided on the outer wall of the cylinder 7; the magazine 14 is equipped with a gasket 518 at its top end, which communicates with the air inlet port and achieves sealing via interference compression. Further, a projectile holding lip 18 is arranged on the sidewall of the magazine 14 to clamp the projectile 516; a projectile loading rod is disposed below the cylinder 7 to transfer the projectile 516 clamped by the projectile holding lip 18 into the chamber. Further, the front end of the cylinder 7 is inserted into a cavity of the hop-up rubber 6, with the outer wall of the cylinder 7 front end and the inner wall of the cavity forming an interference-fit seal.

The pre-pressure in the chamber enables the accumulation of a specific amount of energy within the cylinder 7, which is instantaneously released to convert the stored energy into kinetic energy for further accelerating the projectile 516. Consequently, the projectile 516 attains a higher muzzle velocity, allowing it to travel a greater distance per unit time, thereby effectively extending the effective range and enhancing ballistic stability.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
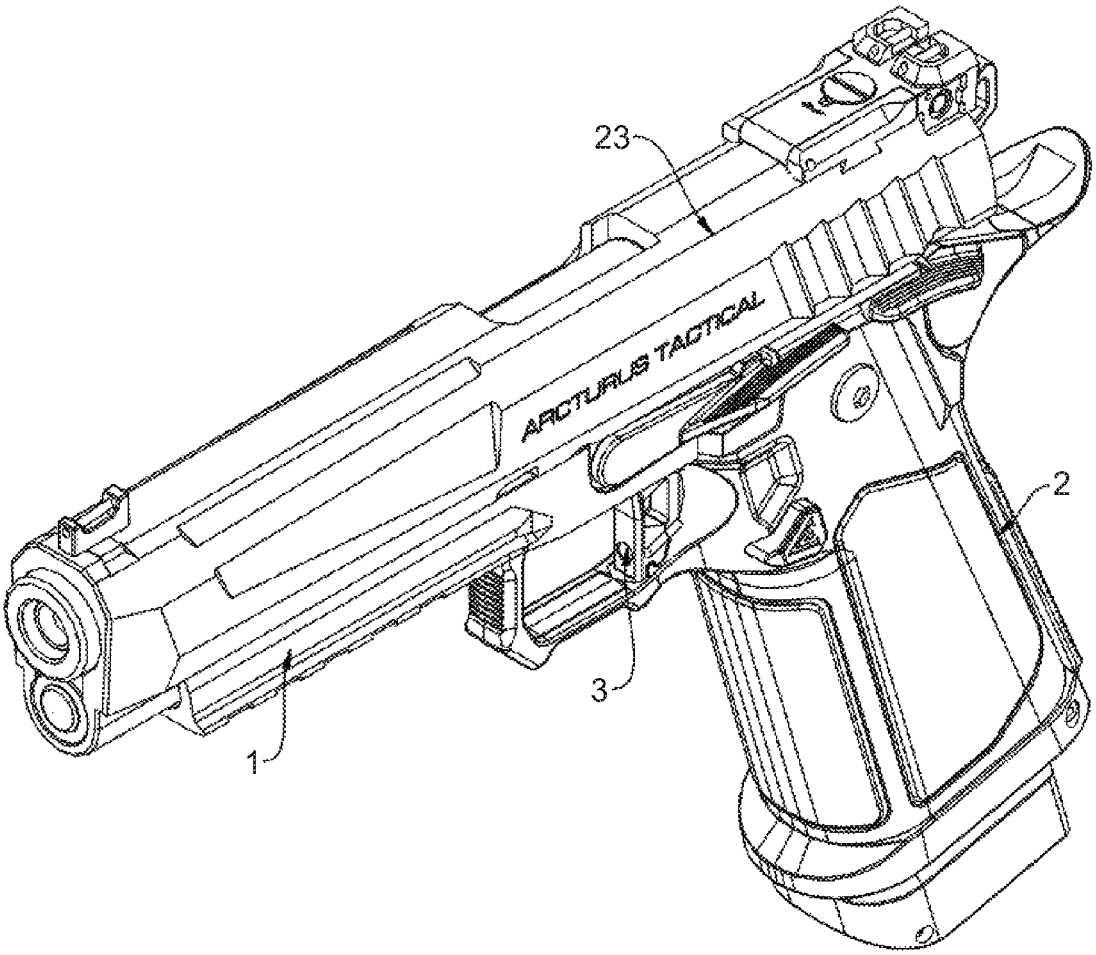
FIG. 1 is an isometric view of an air gun according to one embodiment of the invention.
Figure 2:
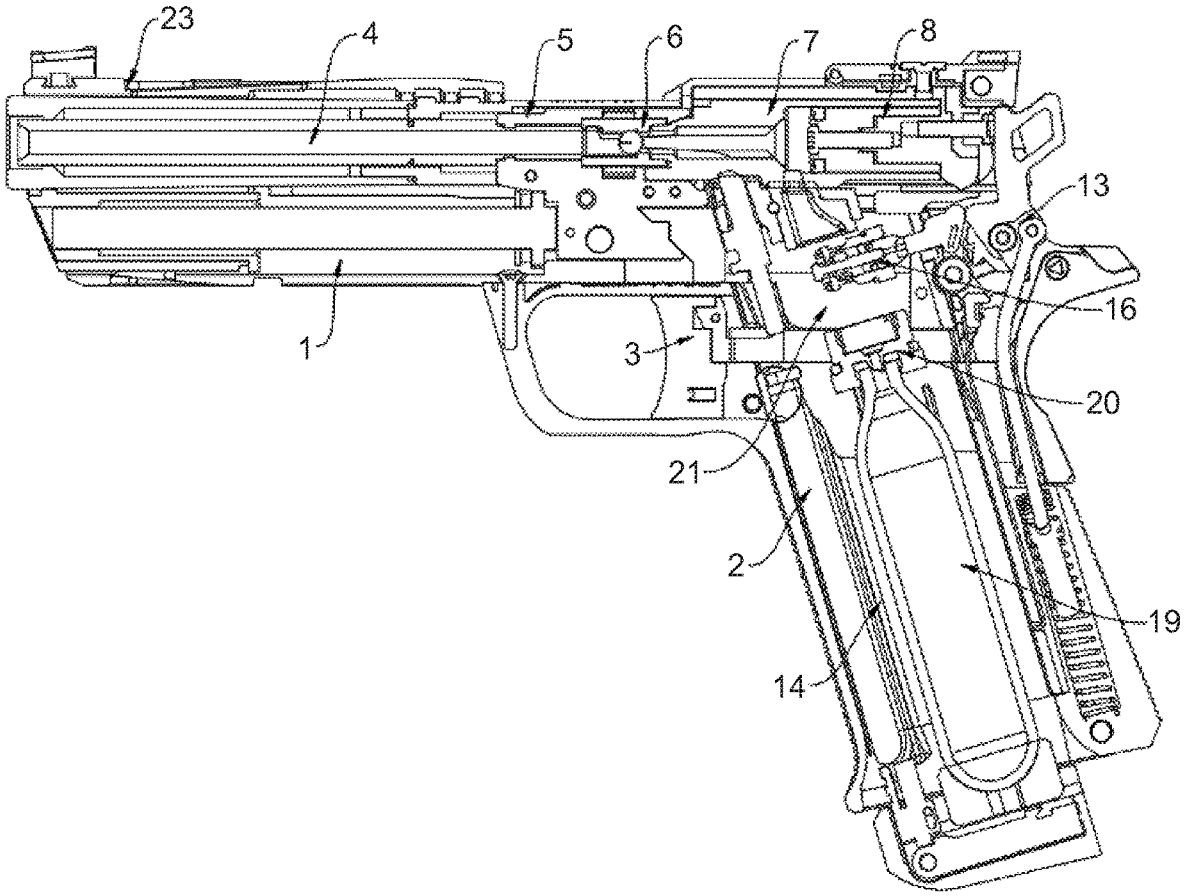
FIG. 2 is a sectional view of the air gun shown in FIG. 1.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright or vertical position of a gun or firearm is when assembled and held by a shooter, ready to shoot (i.e., fire or discharge), with the bore of the barrel of the gun extending generally horizontally or level along a longitudinal axis and the trigger extending generally downward. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

The terms "coupled" and "connected" mean at least either a direct electrical or mechanical connection between the connected items or an indirect connection through one or more passive or active intermediary devices.

A long range and high accuracy pneumatic air gun includes a gun body 1, a grip 2, a trigger 3, a slide 23, and a firing mechanism that cooperates interactively with the trigger 3. A hop-up chamber 5 is arranged inside the slide 23, with the front end of the hop-up chamber 5 connected to an inner barrel 4 and the rear end connected to a cylinder 7. A magazine 14 is arranged inside the grip 2. A hop-up rubber 6 is arranged inside the hop-up chamber 5, and an adjustment assembly is also provided within the hop-up chamber 5 for adjusting the tightness of the hop-up rubber 6. The cylinder 7 includes a chamber that communicates with the inner cavity of the hop-up rubber. A gas-cutoff valve is slidably arranged within the chamber. The gas-cutoff valve has a rod portion and a head portion. The rod portion can slide axially within the cylinder, and the head portion is connected to one end of the rod. The head portion slides to block or open the front end of the chamber. A rubber piston is also installed at the rear end of the chamber to provide a seal. Further, the rear end of the cylinder is sealed by a rubber piston, which includes a plug, a locking bolt, and a sealing ring. The plug is installed inside the rear end of the slide, and the locking bolt is mounted on the outer wall of the plug via the sealing ring. The outer surface of the sealing ring fits closely against the inner wall of the cylinder.

Further, a protrusion for pressing down the projectile is formed at the top of the inner side wall of the hop-up rubber. The adjustment assembly includes an adjustment ring and an adjustment dial. The adjustment ring is sleeved around the outer surface of the hop-up rubber, and the adjustment dial is used to control the movement of the adjustment ring, so as to tighten or loosen the hop-up rubber. Further, a rotating shaft is provided on the hop-up chamber, and the adjustment dial is mounted on the rotating shaft. An engagement groove is formed on the end face of the adjustment dial, and the adjustment ring includes a transmission component, which is slidably inserted into the engagement groove. Further, a radially extending limiting block is formed on the outer wall of the hop-up rubber. A limiting slot is formed through the hop-up chamber, into which the limiting block is inserted to achieve secure positioning.

A gas supply route is arranged inside the magazine. This gas supply route has an gas inlet end and an gas outlet end that communicates with the chamber of the cylinder. Along the path between the gas inlet and gas outlet ends, an outlet valve and an inlet valve are provided. A secondary gas chamber is arranged within the gas supply route above the inlet valve. Further, the inlet valve has a cylindrical tubular structure. The outer wall of the inlet valve fits tightly against the inner wall of the gas supply route, and a gas nozzle is recessed in the lower end surface of the inlet valve to communicate with the secondary gas chamber. Further, a gas canister is arranged inside the magazine, the gas outlet end of which is connected to a gas nozzle, and the interior of the gas canister is filled with liquid $CO_2$. Further, the magazine is provided with a projectile feeding channel for temporarily storing projectiles. A projectile-holding lip is also provided on the magazine. This holding lip includes a clamping lip capable of securing a single projectile. A projectile pushing rod is arranged below the cylinder to push the projectile from the clamping lip into the hop-up rubber.

The air gun disclosed herein improves gas stability and energy efficiency by incorporating a large secondary gas chamber between the inlet valve and the outlet valve. This structure allows the liquid $CO_2$ gas from the gas bottle to vaporize, expand, and stabilize in pressure within the secondary chamber. As a result, the gas released through the outlet valve is in a fully gaseous state. This design effectively enhances vaporization stability, ensuring that the gas is always in vapor form upon release. It reduces the cooling effect of liquid gas expansion on the entire magazine, stabilizes the internal pressure of the magazine, improves the working pressure, and ensures consistent output pressure. It also increases the effective utilization rate of liquid $CO_2$ gas. The resulting performance enhancement is significant: projectiles gain higher muzzle kinetic energy, and the fluctuation of muzzle energy between shots is reduced, leading to greater shooting accuracy. Additionally, with the same volume of commercially available gas canisters, more projectiles can be fired effectively, reducing gas consumption and operating cost.

The air gun disclosed herein utilizes pre-chamber pressurization to allow the cylinder to store a certain amount of potential energy, which is then released instantaneously to convert the stored energy into kinetic energy for projectile launching. This cylinder pressurization mechanism significantly increases the kinetic energy of the projectile, enabling it to overcome the frictional resistance generated by the hop-up rubber. As a result, it effectively eliminates the problem of projectile jamming caused by excessive hop-up friction. The air gun disclosed herein increases the kinetic energy of the projectile through pre-pressurization of the gas chamber and enlarges the contact area between the hop-up rubber and the projectile to apply greater friction, thereby achieving a stronger top spin effect that counteracts gravitational drop during long-distance flight, resulting in a more stable trajectory and extended range.

Referring especially to FIGS. 1 to 9, a long range and high accuracy pneumatic air gun includes a gun body (1), a grip (2), a trigger (3), a slide (23), and a firing mechanism (13) that cooperates with the trigger (3); the interior of the slide (23) is provided with an hop-up chamber (5), the front end of the hop-up chamber (5) is connected to the inner barrel (4), the rear end is connected to the cylinder (7), and the interior of the gun handle (2) is provided with a magazine (14).

Inside the hop-up chamber (5), a hop-up rubber (6) is provided, and a regulating component for adjusting the tightness of the hop-up rubber (6) is also arranged within the hop-up chamber (5).

The cylinder (7) is provided with a chamber that communicates with the inner cavity of the hop-up rubber (6), in which a cut-off valve (9) is slidably arranged, the cut-off valve (9) having a rod portion and a head portion, the rod portion being axially slidable within the cylinder (7), with the head portion connected to one end of the rod portion and configured to slide for blocking or opening the front end of the chamber, and a rubber piston (8) is also installed within the chamber to seal its rear end.

A gas supply route is provided inside the magazine (14), the gas supply route having an gas inlet end (22) and an gas outlet end (15) that communicates with the inner cavity of the cylinder (7), with an outlet valve (16) and an inlet valve (20) arranged along the path between the gas outlet end (15) and the gas inlet end (22), and a secondary gas chamber (21) is provided within the gas supply route above the inlet valve (20).

Specifically, to address the problem of poor gas vaporization efficiency in the prior art, the air gun disclosed herein optimizes the conventional vaporization structure by designing a secondary gas chamber (21) between the inlet valve (20) and the outlet valve (16), allowing the liquid $CO_2$ to vaporize into gas within the secondary gas chamber (21), expand, and stabilize in pressure. thereby increasing the gas work pressure, improves the stability of the working cycle, and enhancing the projectile's muzzle velocity.

To address the problem in prior art hop-up chamber (5) structures where the hop-up effect on heavy projectiles is not significant, the air gun disclosed herein improves the shapes and internal structures of the hop-up rubber (6), cylinder (7), and cut-off valve (9), and adopts a sealed chamber system that achieves initial pressurization through preset projectile friction; the rear end of the cylinder (7) is sealed by a rubber piston (8), and a gasket rubber element is installed inside the gas outlet end (15) of the magazine (14); the cylinder (7) and magazine (14) are sealed by interference fit compression via the gasket rubber 518, and during firing, the magazine (14) releases gas into the chamber, increasing the chamber pressure until the pressure behind the Cut-off valve (9) exceeds the friction between the projectile and the hop-up rubber (6), at which point the push rod of the Cut-off valve (9) advances the projectile into the hop-up rubber (6) and releases the gas to propel the projectile, while the adjustment assembly increases the pressing area of the hop-up rubber (6) to enlarge the contact friction area as the projectile passes through it, thereby achieving a stronger hop-up effect. In one embodiment, pulling the trigger of the gun causes a hammer to strike the locking bolt, sending the cutoff valve forward and pushing the projectile past the friction area of the hop up rubber (i.e., the pressure in the chamber combined with the force of the hammer strike causes the projectile to begin moving through the hop up rubber and the barrel).

Figure 5:
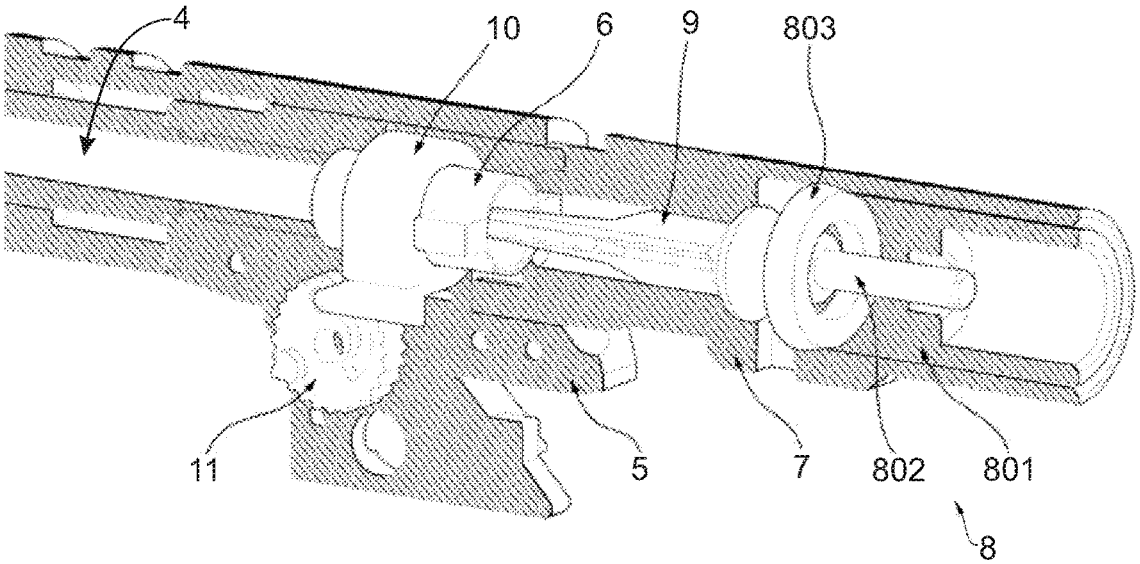
FIG. 5 is a sectional view of the structure shown in FIG. 4.
Figure 6:
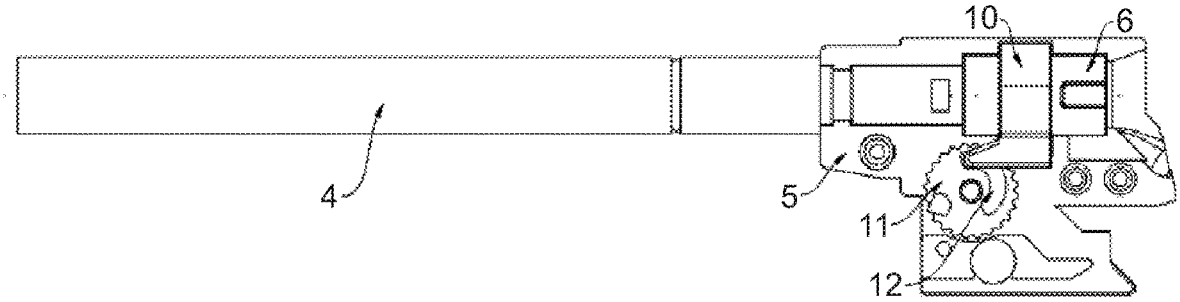
FIG. 6 is a rear isometric view of a schematic diagram of the hop-up chamber in a non-adjusted state in the air gun of FIG. 1
Figure 7:
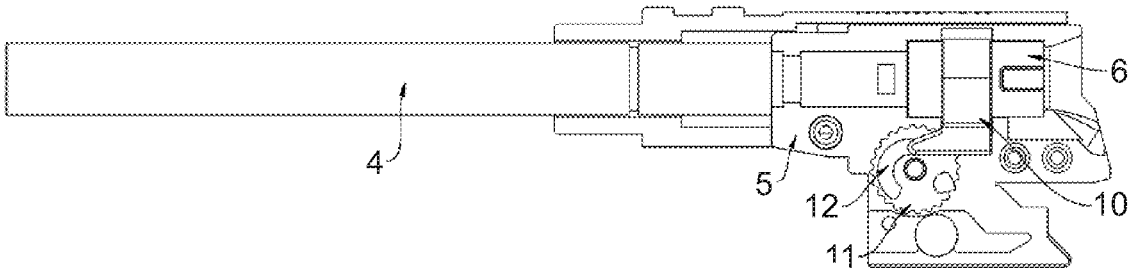
FIG. 7 is a side perspective view of a schematic diagram of the hop-up chamber after adjustment in the air gun of FIG. 1.

Referring especially to FIGS. 5, 6, and 7, a protrusion for pressing down the projectile is provided at the top of the inner side wall of the hop-up rubber (6), and the adjustment assembly includes an adjustment ring (10) and an adjustment dial (11), wherein the adjustment ring (10) is sleeved around the outer surface of the hop-up rubber (6), and the adjustment dial (11) is used to control the movement of the adjustment ring (10) to tighten or loosen the hop-up rubber (6).

The hop-up adjustment adopts a rotation-based adjustment design using the adjustment ring (10), replacing the traditional lever-type hop-up adjustment design; compared with the pressure lever, the adjustment ring (10) design increases the contact area with the hop-up rubber (6) during downward compression, thereby enlarging the friction area between the projectile and the hop-up rubber (6) as the projectile passes through, generating greater frictional force and thus achieving a stronger hop-up effect; this adjustment ring (10) design also allows the pressure exerted on the projectile to be more evenly distributed, resulting in a more stable and effective hop-up effect that stabilizes the projectile's trajectory.

This structural improvement provides sufficient hop-up spin and higher muzzle energy for heavier projectiles made of materials such as steel balls, thereby extending their effective range, and the design herein incorporates enhanced sealing and reinforced structures at the connection between the inner barrel (4) and the cylinder (7), improving pneumatic efficiency, enabling the system to withstand higher pressure, and ensuring reliable operation with each shot, thus enhancing the shooting accuracy and service life of the air gun.

The hop-up adjustment ring (10) of the hop-up chamber (5) structure can adjust the downward pressure applied by the inner pressing surface of the hop-up rubber (6) onto the projectile, thereby changing the friction force the projectile receives and achieving different hop-up trajectories; in this design, the adjustment assembly includes the hop-up adjustment dial (11) and the hop-up adjustment ring (10), and unlike traditional hop-up adjustment structures available on the market, this design adopts a ring-shaped pressing structure rather than a columnar or spherical form, which, during the pressing process, minimizes excessive deformation of the hop-up rubber (6) to ensure consistency and stability as the projectile passes through the hop-up rubber (6); more importantly, the ring-shaped structure ensures a uniform downward motion of the inner pressing surface of the hop-up rubber (6) during compression, resulting in more stable contact between the pressing surface and the projectile, and significantly increasing the effective contact area and duration of friction between them, so this design enables the projectile to achieve a stronger hop-up, further improving its maximum range and trajectory stability.

It has been verified that the structure of the air gun disclosed herein can ensure increased effective shot count when using a 12 g $CO_2$ cartridge to fire 4.5 mm steel ball projectiles, with the variation in muzzle energy of the first 40 shots being less than 10%, a maximum range reaching up to 80 meters, and shooting accuracy achieving a extreme spread within 30 cm at a distance of 30 meters.

In addition, in prior art $CO_2$ powered air gun magazines (14), the liquid $CO_2$ gas inside the gas canister (19) has only a very limited vaporization space along the gas route during operation, which, although capable of slightly improving vaporization efficiency, remains insufficient in effect. The structure disclosed herein improves upon the prior art by using a relatively large secondary gas chamber (21) between the inlet valve (20) and the outlet valve (16), allowing the liquid $CO_2$ from the gas canister (19) to vaporize, expand, and stabilize in pressure within the secondary chamber (21), ensuring that the gas is in a fully gaseous state when released through the outlet valve (16). This significantly enhances vaporization stability, ensures that each release is of gaseous $CO_2$, reduces the cooling effect on the entire magazine (14) caused by gas expansion, stabilizes internal pressure within the magazine (14), and improves working pressure, output pressure stability, and the effective utilization rate of liquid $CO_2$ gas. This structure demonstrates significant performance improvements when applied to 4.5 mm air guns, allowing the projectile to achieve higher muzzle energy while maintaining stable muzzle velocity and high shooting accuracy for each shot; under the same commercially available gas canister (19) capacity, more projectiles can be effectively fired, resulting in reduced consumption of gas canister (19) resources.

In the structure of the hop-up chamber (5) in conventional air guns, the gas acts directly on the projectile, and the energy of the gas in the cylinder (7) is gradually converted into kinetic energy as it passes through the barrel (4). In the present design, however, pre-chamber pressure allows the cylinder (7) to store a certain amount of pre-pressurized energy, which is then released instantaneously and converted into greater kinetic energy for the projectile. This pressurization of the cylinder (7) significantly increases the projectile's kinetic energy, effectively counteracting the frictional resistance of the hop-up rubber (6) and solving the jamming problem caused by excessive hop-up friction.

Compared with prior art air gun products on the market, the newly designed hop-up rubber (6) of the air gun disclosed herein utilizes pre-chamber pressurization to achieve higher projectile kinetic energy, and increases the contact area between the hop-up rubber (6) and the projectile, enabling the hop-up rubber (6) to apply greater frictional force, thereby generating a stronger hop-up effect that offsets the gravitational drop of the projectile during long-distance flight, stabilizes the trajectory, and extends the effective range.

Referring especially to FIGS. 6 and 7, a rotating shaft is provided on the hop-up chamber (5), and the adjustment dial (11) is mounted on the rotating shaft; the end face of the adjustment dial (11) is further provided with an spiral groove (12), and the adjustment ring (10) includes a transmission component, which is slidably inserted into the interior of the spiral groove (12). Specifically, the adjustment dial (11) rotates around the rotating shaft, and since the transmission component of the adjustment ring (10) is slidably inserted into the spiral groove (12) on the end face of the adjustment dial (11), the circular motion of the adjustment dial (11) is converted into vertical movement of the adjustment ring (10); the adjustment ring (10) is sleeved around the outer side of the hop-up rubber (6), and its upward or downward movement compresses or relaxes the hop-up rubber (6), thereby changing the frictional force applied by the hop-up rubber (6) to the projectile; this structural design enables smooth adjustment with relatively high precision. Through the coordination of the rotating shaft, the spiral groove (12), and the transmission component of the adjustment ring (10), the rotation of the adjustment dial (11) is efficiently converted into the vertical movement of the adjustment ring (10), ensuring stability and reliability in the adjustment process, enabling precise control of the tightness of the hop-up rubber (6), and providing appropriate hop-up force for different shooting distances, thereby further enhancing the shooting performance and accuracy of the air gun.

Figure 9:
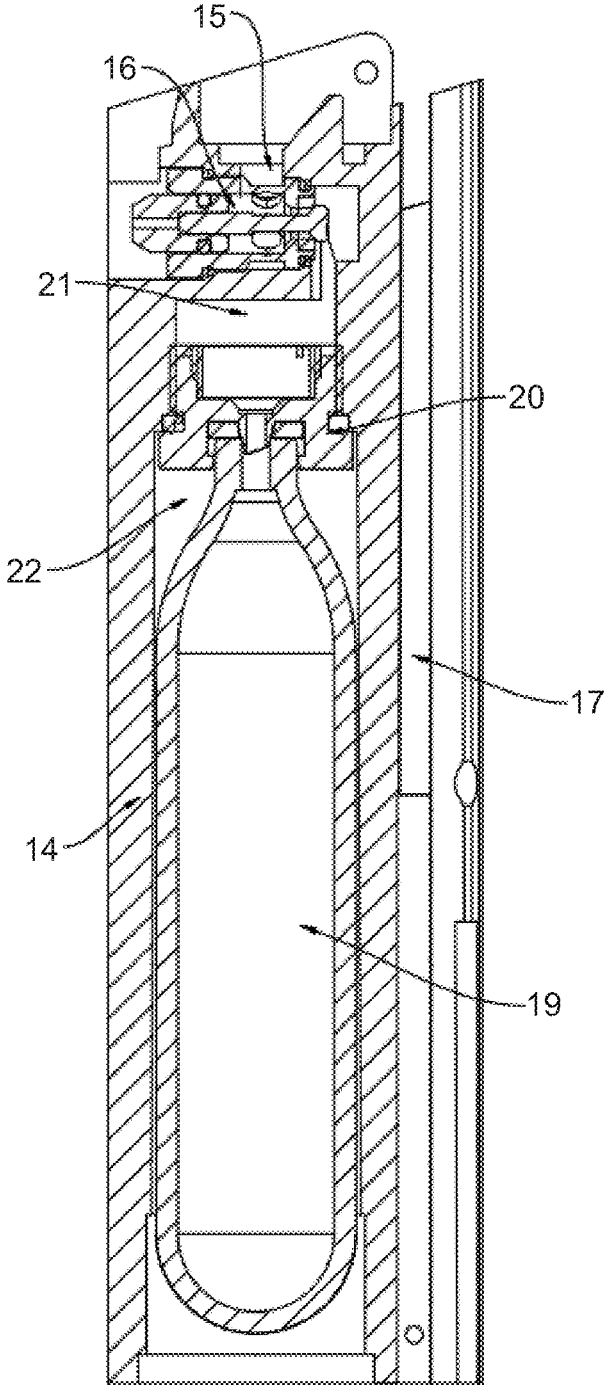
FIG. 9 is a side perspective view of a sectional structural schematic diagram of the magazine in the air gun of FIG. 1.
Figure 10:
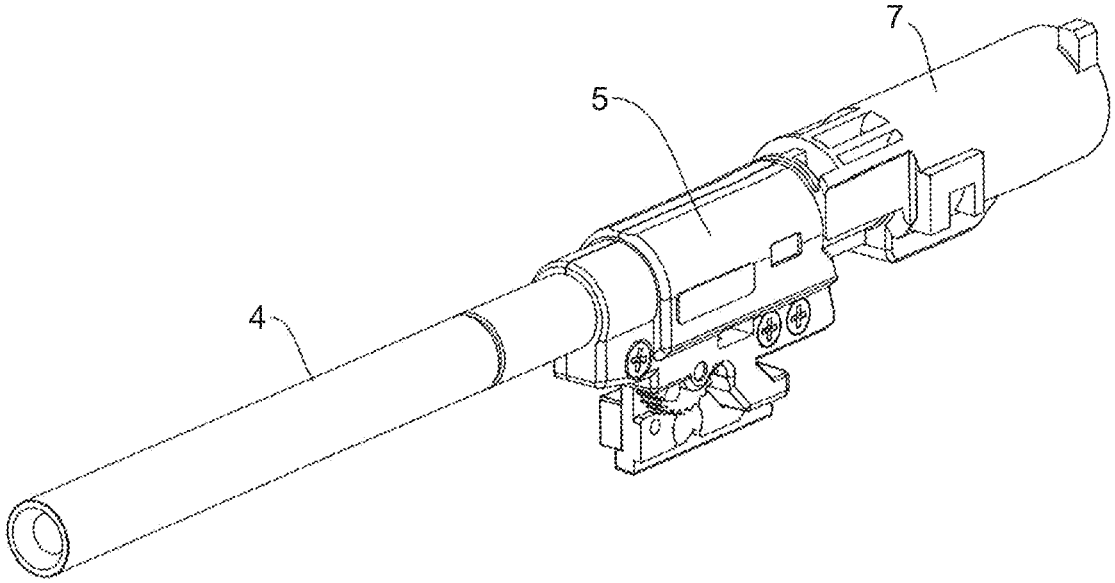
FIG. 10 is a front isometric view of a hop up assembly of an air gun.
Figure 11:
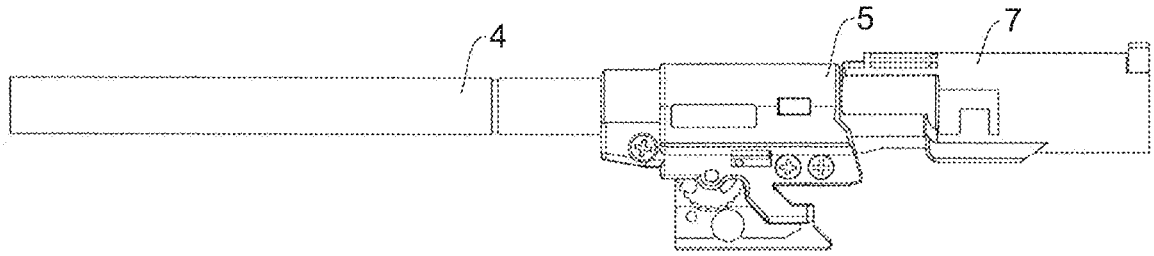
FIG. 11 is a side schematic view of the assembly of FIG. 10.

Referring especially to FIG. 9, the inlet valve (20) has a cylindrical tubular structure, with its outer wall closely fitted to the inner wall of the gas supply route, and the lower end surface of the inlet valve (20) is recessed to form a gas nozzle that communicates with the secondary gas chamber (21). The inlet valve (20) has a cylindrical tubular structure, with its outer wall fitting tightly against the inner wall of the gas supply route to ensure good airtightness; the liquid $CO_2$ from the gas canister (19) enters the inlet valve (20) through the gas nozzle and begins the vaporization and pressurization process within the secondary gas chamber (21); the gas nozzle communicates with the secondary gas chamber (21), and the structural design of the inlet valve (20) ensures that the liquid $CO_2$ can smoothly flow into the secondary gas chamber (21) while effectively preventing gas leakage. The inlet valve (20) fits tightly with the gas supply route, improving the airtightness of the gas supply system and reducing the likelihood of gas leakage, thereby ensuring that the liquid $CO_2$ can effectively enter the secondary gas chamber (21) for vaporization, which enhances the overall energy utilization efficiency and working stability of the air gun system, and contributes to improving the projectile's muzzle velocity and effective range.

Referring especially to FIG. 9, a gas canister (19) is also arranged inside the magazine (14), with the outlet end of the gas canister (19) connected to a gas nozzle, and the interior of the gas canister (19) storing liquid $CO_2$. The gas canister (19) stores liquid $CO_2$, and its outlet end is connected to the gas nozzle of the inlet valve (20). When the air gun operates, the liquid $CO_2$ in the gas canister (19), under pressure, flows through the gas nozzle into the inlet valve (20), and subsequently enters the secondary gas chamber (21), where the liquid $CO_2$ begins to vaporize and expand due to environmental factors and its own physical properties, thereby providing the driving force for shooting the projectile. The gas canister (19), serving as the storage container for liquid $CO_2$, provides a stable power source for the air gun system; in coordination with the secondary gas chamber (21) and the inlet valve (20), it ensures that the liquid $CO_2$ can efficiently enter the power cycle of the air gun, effectively solving the problems in existing air guns such as insufficient vaporization of liquid $CO_2$ and low working pressure, thereby enhancing the overall performance of the air gun.

Figure 3:
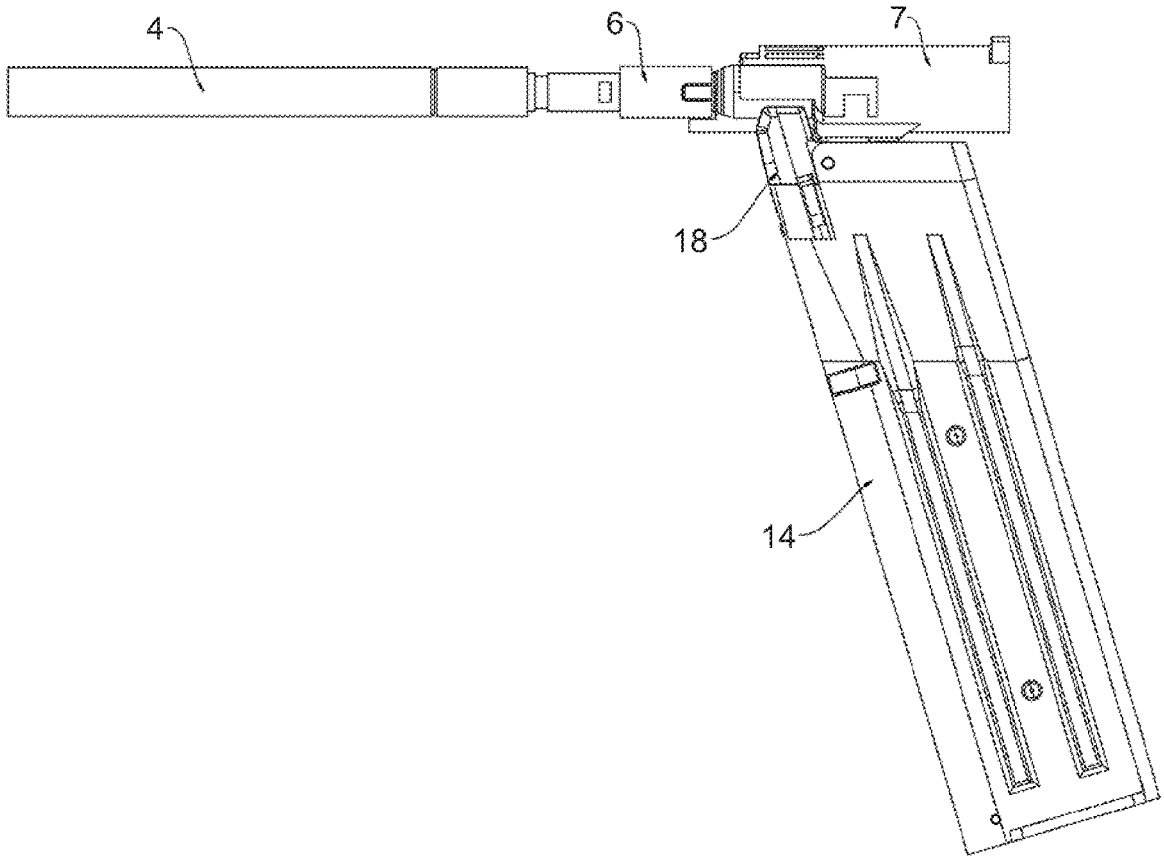
FIG. 3 is a side perspective view of the connection structure between an magazine and an air cylinder in the air gun of FIG. 1.
Figure 4:
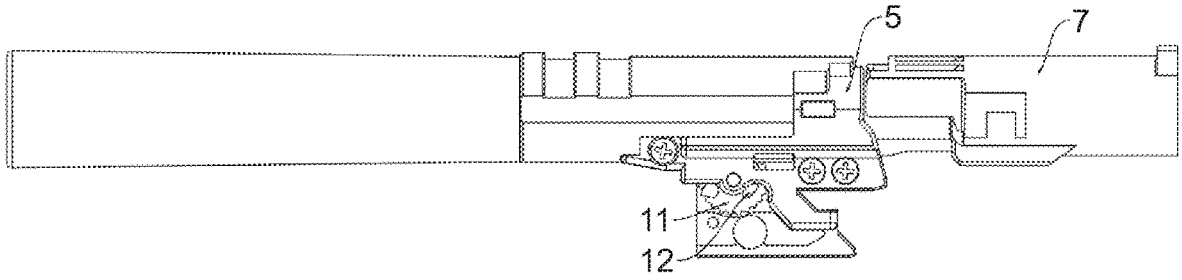
FIG. 4 is a side perspective view of a schematic diagram of the hop-up chamber and the cylinder in the air gun of FIG. 1.
Figure 8:
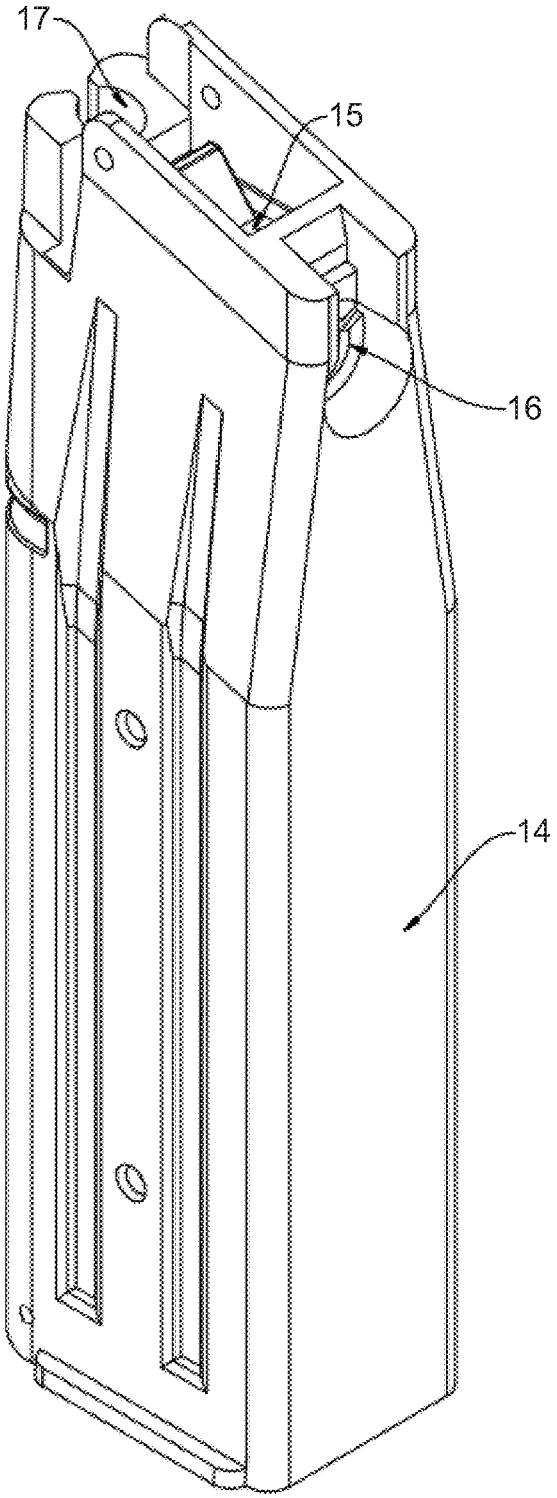
FIG. 8 is an isometric view of a schematic diagram of the magazine structure in the air gun of FIG. 1.

Referring especially to FIGS. 3, 8, and 9, the magazine (14) is further provided with a projectile feeding channel (17) for temporarily storing projectiles, and also equipped with a projectile-holding lip (18), which includes a magazine lip of securely holding a single projectile. A projectile follower is arranged below the cylinder (7) to push the projectile from the magazine lip into the hop-up rubber (6). The projectile feeding channel (17) on the magazine (14) is used for temporarily storing projectiles, and the magazine lip of the projectile-holding lip (18) is capable of securely holding a single projectile. When the air gun is ready to fire, the projectile follower located below the cylinder (7) moves forward to push the projectile from the magazine lip into the hop-up rubber (6). Then, driven by the high-pressure gas inside the cylinder (7), the projectile passes through the hop-up rubber (6), where it gains hop-up spin, and is subsequently shooted out of the inner barrel (4). By providing the projectile feeding channel (17) and the projectile follower (18), orderly storage and precise delivery of projectiles are achieved; in coordination with these components, the projectile follower ensures that each projectile accurately enters the hop-up chamber (5), thereby improving the feeding efficiency and firing continuity of the air gun. This design helps enhance the shooting performance of the air gun, reduces feeding malfunctions, and improves the overall user experience.

Referring especially to FIG. 5, a limiting block extending radially is provided on the outer wall of the hop-up rubber (6), and a limiting slot is formed through the hop-up chamber (5), with the limiting block inserted into the interior of the limiting slot. The limiting block on the outer wall of the hop-up rubber (6) is inserted into the limiting slot of the hop-up chamber (5). When the adjustment ring (10) compresses or releases it, the fit between the limiting block and the limiting slot ensures that the hop-up rubber (6) deforms only in the designated direction, preventing twisting or displacement during adjustment and ensuring that the projectile receives uniform and stable friction as it passes through the hop-up rubber (6). The structural design of the limiting block and the limiting slot enhances the stability and reliability of the adjustment process of the hop-up rubber (6), ensuring that the projectile receives a stable and appropriate amount of hop-up spin as it passes through the hop-up rubber (6), which guarantees the stability of the projectile's trajectory and thereby improves the shooting accuracy and range of the air gun.

Referring especially to FIG. 5, the rear end of the cylinder (7) is sealed by a rubber piston (8), which includes a piston body (801), a locking bolt (802), and a sealing ring (803). The piston body (801) is installed inside the rear end of the slide (23), the locking bolt (802) is mounted on the outer wall of the piston body (801) through the sealing ring (803), and the outer surface of the sealing ring (803) fits closely against the inner wall of the cylinder (7). When there is high-pressure gas inside the cylinder (7), the rubber piston (8) can effectively seal the rear end of the cylinder (7) to prevent gas leakage. During the sliding motion of the slide (23), the structural design of the rubber piston (8) allows it to accommodate the movement of the slide (23) while maintaining excellent sealing performance. This structural design of the rubber piston (8) ensures excellent airtightness at the rear end of the cylinder (7), preventing high-pressure gas leakage and improving the working efficiency of the air gun system. Meanwhile, its installation with the slide (23) allows the piston to maintain a stable sealing effect during the firing process, which helps increase the projectile's muzzle velocity, enhances the stability of the working cycle, and extends the service life of the air gun.

The projectile feeding channel (17) on the magazine (14) stores projectiles temporarily, while the magazine lip of the projectile holding lip (18) holds a single projectile securely. The projectile follower located below the cylinder (7) pushes the projectile from the magazine lip into the hop-up rubber (6). The adjustment dial (11) of the adjustment assembly controls the movement of the adjustment ring (10), which is sleeved around the outer surface of the hop-up rubber (6). By tightening or loosening the adjustment ring (10), the tension of the hop-up rubber (6) can be adjusted. A friction Point at the top of the inner side wall of the hop-up rubber (6) presses down on the projectile, causing it to hop-up spin as it passes through the hop-up rubber (6).

Power Source and Firing Principle: The gas canister (19) stores liquid $CO_2$, with its outlet end connected to the gas nozzle on the lower end surface of the inlet valve (20). A secondary gas chamber (21) is arranged in the gas supply route above the inlet valve (20). After the liquid $CO_2$ vaporizes, it enters the secondary gas chamber (21), and then flows through the gas supply route. At this stage, the gas has not yet entered the cylinder (7), but is stored in the cavity between the outlet valve (16) and the inlet valve (20). When firing, the trigger (3) interacts with the firing mechanism (13), causing the release of the stored gas through the outlet valve (16) and inlet valve (20) into the inner chamber of the cylinder (7). The gas enters the firing chamber, and pressure builds up until it exceeds the friction force between the projectile and the hop-up rubber (6). At this point, the projectile follower pushes the projectile into the hop-up rubber (6), and the gas continues to propel the projectile forward. The use of a compression-ring-based hop-up adjustment design increases the contact area with the hop-up rubber (6) during downward pressing, thereby enlarging the frictional area between the projectile and the hop-up rubber (6) as the projectile passes through, resulting in a stronger hop-up spin effect.

The air gun disclosed herein provides a hop-up chamber structure for air gun including a hop-up chamber, a hop-up rubber, and an adjustment assembly for adjusting the tightness of the hop-up rubber. The hop-up chamber has a cylindrical chamber cavity. The hop-up chamber is disposed on a barrel along a front-rear direction. The hop-up rubber is arranged within the chamber cavity, with its axis parallel to that of the chamber cavity. A front end of the hop-up rubber sleeve is sleeved over the inner barrel, while a rear end communicates with a compression chamber. A protrusion for pressing down on a projectile is formed on the top of an inner wall of the hop-up rubber. The adjustment assembly includes an adjustment ring and a dial. The adjustment ring is sleeved over the hop-up rubber. The adjustment dial is configured to control movement of the adjustment ring to compress or relieve the hop-up rubber. Furthermore, a spiral groove is formed on the adjustment dial, coaxially arranged with its central axis. An adjustment lever is disposed on the outer wall of the lower portion of the adjustment ring, extending axially along the adjustment ring. A follower shaft is provided at an end of the adjustment lever away from the adjustment ring, wherein the follower shaft is inserted into the spiral groove. Furthermore, the follower shaft is rotatably connected to the adjustment lever, and an outer wall of the follower shaft conforms to an inner wall of the spiral groove. Furthermore, an anti-slip pattern is disposed on a peripheral surface of the adjustment dial, and a side wall of the hop-up chamber is provided with an accommodation notch exposing the adjustment dial. Furthermore, the hop-up chamber is divided into a chamber housing L and a chamber housing R. A rotating shaft is rotatably disposed between the chamber housing L and the chamber housing R, extending along a width direction of the hop-up chamber. The adjustment dial is mounted on the rotating shaft. Furthermore, an outer wall of the hop-up rubber closely adheres to an inner wall of the chamber cavity. A protrusion disposed on an inner wall of the hop-up rubber extends radially. Furthermore, a limiting block extending radially is disposed on the outer wall of the hop-up rubber. Both the chamber housing L and the chamber housing R are provided with limiting slots for embedding the limiting block. Furthermore, the chamber housing R is provided with a plurality of housing screws extending toward the chamber housing L. An inner side wall of the chamber housing L is provided with a plurality of threaded sockets for the housing screws to thread into.

The air gun disclosed herein incorporates a drive mechanism comprising the adjustment dial 11, spiral groove 12, adjustment lever 317, and adjustment ring 10. This enables users to conveniently and precisely regulate the contact pressure between the hop-up rubber 6 and the projectile. The system fully adapts to variations in projectile material composition, weight, and complex shooting conditions, thereby enhancing the stability and reliability of the hop-up effect. It effectively resolves the prior art challenge of difficult contact pressure adjustment, significantly improving the air gun's shooting range and accuracy. The air gun disclosed herein adopts a screw connection between the chamber housing L 311 and chamber housing R 312, enabling simple and reliable installation and disassembly of the hop-up chamber 5. This facilitates user access for routine maintenance, cleaning, and replacement of wearable parts such as the hop-up rubber 6, effectively resolving the prior art challenge of complex assembly procedures and prolonging the service life of the air gun hop-up chamber structure.

Referring especially to FIGS. 10-15, an air gun includes a hop-up chamber structure for air gun comprising a hop-up chamber 5; a hop-up rubber 6; and an adjustment assembly configured to regulate tightness of the hop-up rubber 6. The hop-up chamber 5 is provided with a cylindrical chamber cavity 314 and is mounted along a front-rear axis on an inner barrel 4. The hop-up rubber 6 is disposed within the chamber cavity 314, with its central axis parallel to that of the chamber cavity 314. A front end of the hop-up rubber 6 is sleeved over the inner barrel 4, while a rear end communicates with a cylinder 7. An inner top surface of the hop-up rubber 6 is provided with a protrusion configured to press downward on a projectile. The adjustment assembly includes: an adjustment ring 10 sleeved over the hop-up rubber 6; and an adjustment dial 11 controlling axial movement of the adjustment ring 10 to compress or relieve the hop-up rubber 6. The contact pressure between the projectile and the hop-up rubber 6 can be adjusted according to varying conditions. This improvement resolves the existing technical challenge of difficult precision regulation of contact pressure in the prior art, thereby enhancing the stability and reliability of the hop-up effect.

Referring especially to FIGS. 10-15, a spiral groove 12 is formed in the adjustment dial 11 and coaxially arranged therewith. An adjustment lever 317 is disposed on an outer wall of a lower portion of the adjustment ring 10 and extends axially along the adjustment lever 317. A cam follower shaft is provided at an end of the adjustment lever 317 distal from the adjustment ring 10, wherein the cam follower shaft is slidably engaged within the spiral groove 12. When rotating the adjustment dial 11, the cam follower shaft within the spiral groove 12 drives the adjustment lever 317 to move linearly. This consequently causes the adjustment ring 10 to move axially within the chamber cavity 314, thereby achieving compression adjustment of the hop-up rubber 6. The synergistic structure of the adjustment dial 11 and spiral groove 12 with the adjustment lever 317 provides a simple yet effective drive mechanism. This design facilitates user operation in regulating the compression degree of the hop-up rubber 6, enabling precise control of contact pressure between the hop-up rubber 6 and projectiles.

Figure 13:
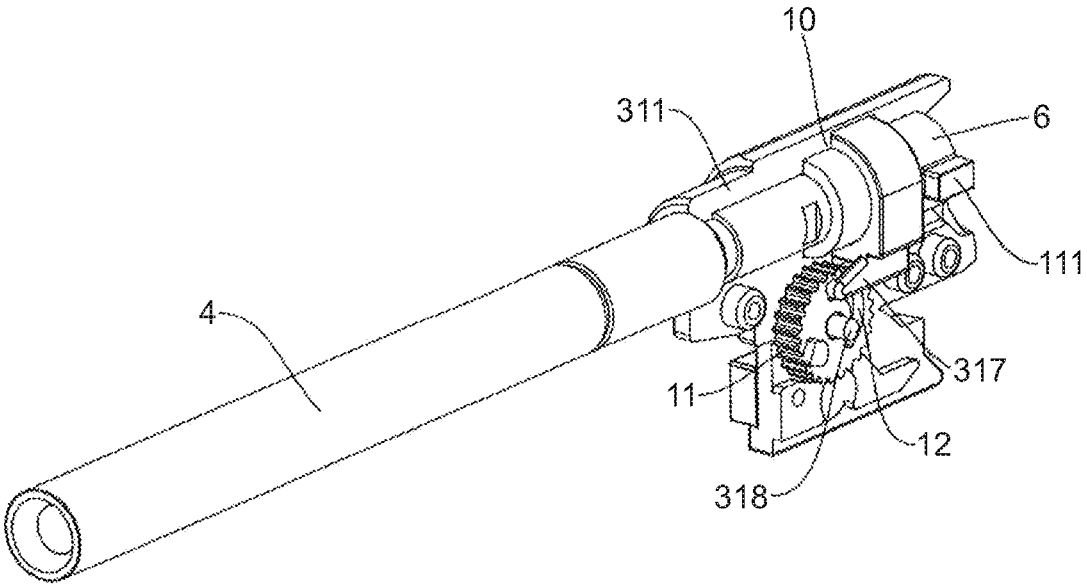
FIG. 13 is a front isometric view of the hop-up chamber with the left chamber housing hidden.
Figure 14:
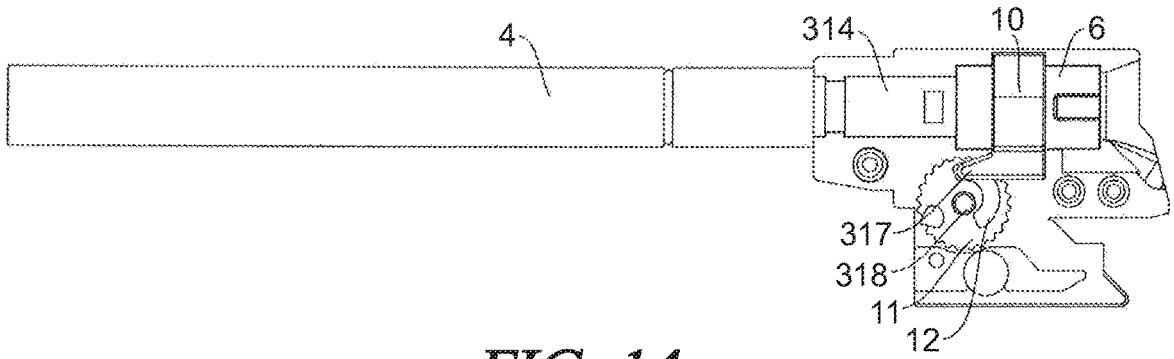
FIG. 14 is a side perspective view of the hop-up chamber in an unadjusted state.
Figure 15:
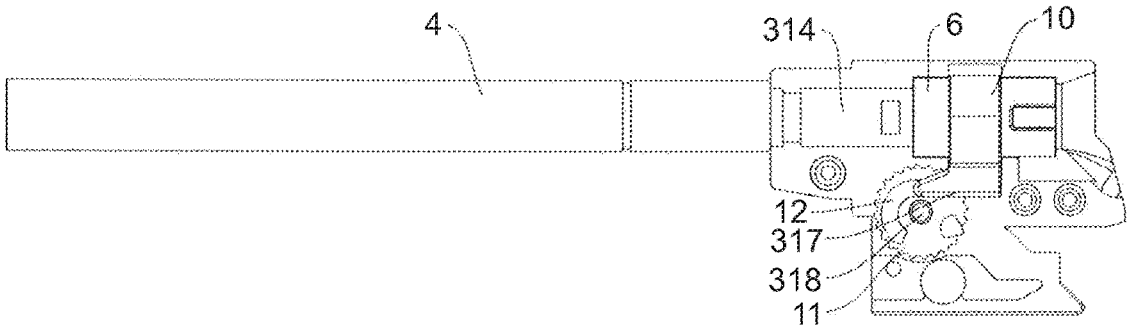
FIG. 15 is a side perspective view of the hop-up chamber in an adjusted state
Figure 16:
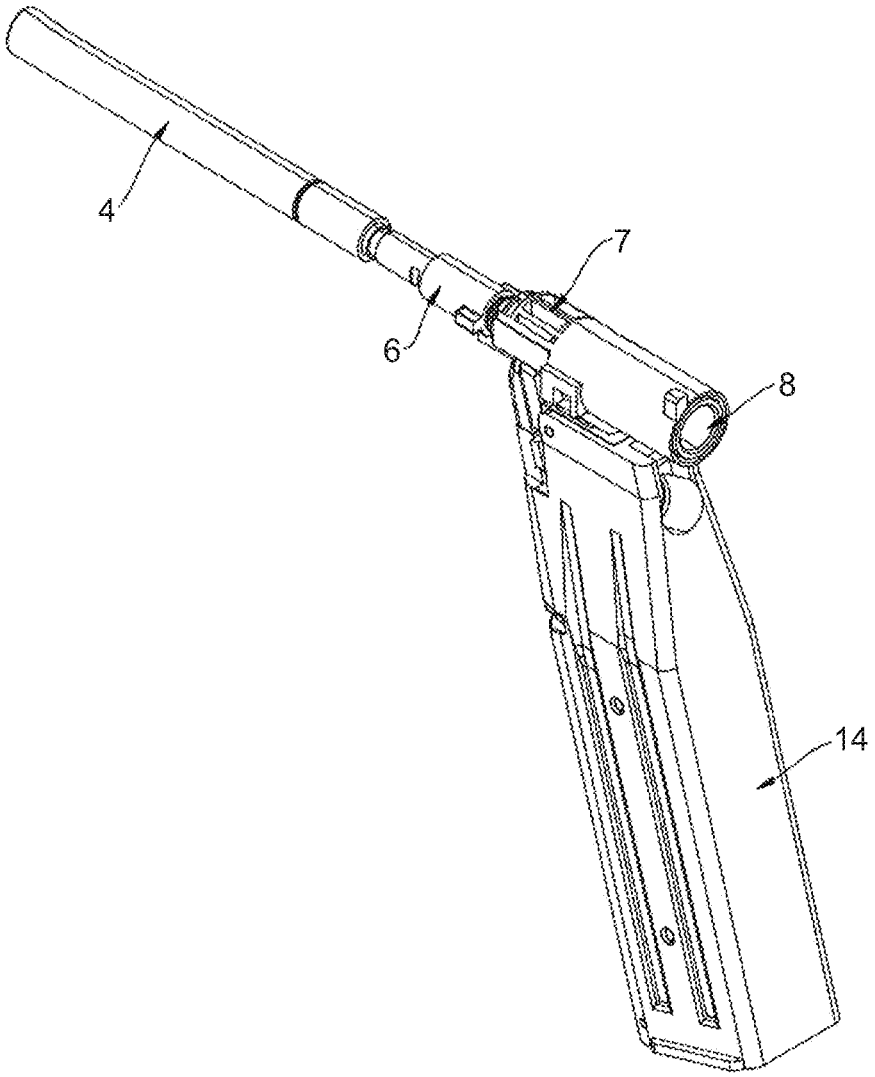
FIG. 16 is a rear isometric view of the magazine and cylinder of the air gun of FIG. 1.
Figure 17:
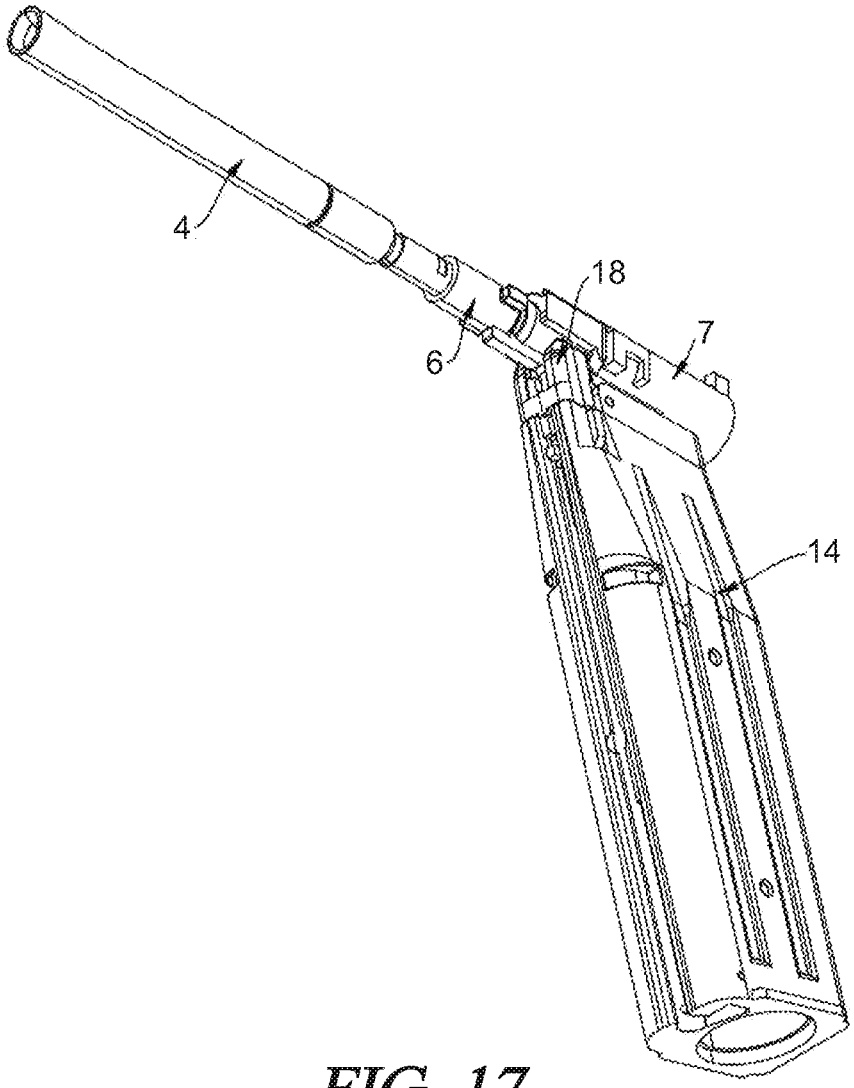
FIG. 17 is a bottom view schematic diagram of the air gun magazine and cylinder of FIG. 16.
Figure 18:
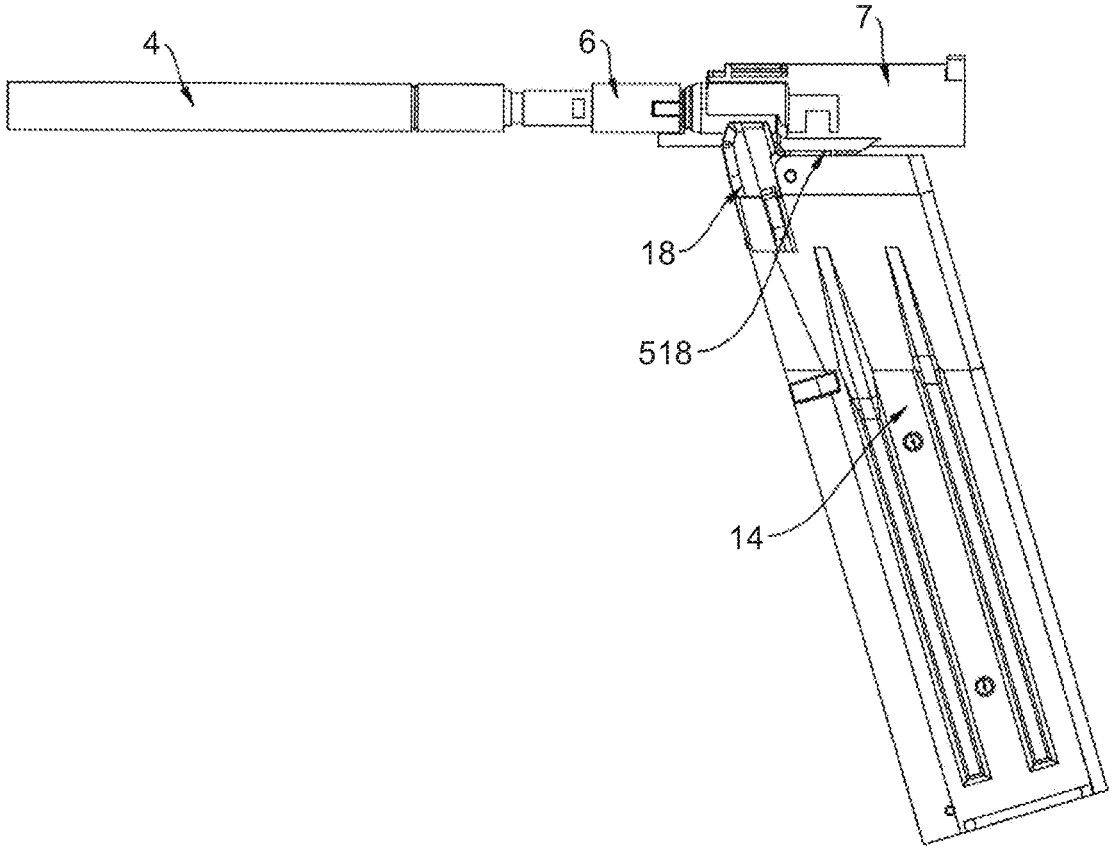
FIG. 18 is a side perspective view of the magazine and cylinder of FIG. 16.

Referring especially to FIG. 13, the cam follower shaft is pivotally mounted on the adjustment lever 317, and an outer wall of the cam follower shaft conformably contacts an inner wall of the spiral groove 12. The pivotal mounting of the cam follower shaft and the conformal contact design with the spiral groove 12 reduce motion resistance and ensure stability during the driving process. This enables more precise and reliable compression adjustment of the hop-up rubber 6, thereby further enhancing the stability of the backspin effect.

Referring especially to FIG. 13, an anti-slip pattern is disposed on the peripheral surface of the adjustment dial 11, and an access notch is provided on the sidewall of the chamber housing R 312 to expose the adjustment dial 11. The anti-slip pattern on the peripheral surface of the adjustment dial 11 facilitates manual rotation by the user. The access notch on the sidewall of the chamber housing R 312 exposes the adjustment dial 11, enabling direct user contact for operation. The anti-slip pattern increases frictional force during user operation, thereby enabling precise rotation. The design of the access notch enhances operational convenience and optimizes user experience.

Referring especially to FIG. 13, the hop-up chamber 5 comprises a chamber housing L 311 and a chamber housing R 312. A rotating shaft 318 is rotatably supported between the chamber housing L 311 and the chamber housing R 312, extending along the width direction of the hop-up chamber 5. The adjustment dial 11 is mounted on the rotating shaft 318. The chamber housing L 311 and the chamber housing R 312 are assembled to form the chamber cavity 314, facilitating the installation and layout of internal components. The rotating shaft 318 provides stable rotational support for the adjustment dial 11, ensuring smooth rotation of the adjustment dial 11. This guarantees the motion precision of the adjustment ring 10, thereby enhancing the accuracy of compression adjustment on the hop-up rubber 6.

Referring to FIG. 13, the outer wall of the hop-up rubber 6 conformably contacts the inner wall of the chamber cavity 314, and protrusions are disposed on the inner wall of the hop-up rubber 6 and extend radially therefrom. The conformal contact between the outer wall of the hop-up rubber 6 and the inner wall of the chamber cavity 314 provides positioning and sealing functions. The radially extending protrusions on the inner wall increase frictional force with projectiles, thereby enhancing the backspin effect. This conformal design ensures stable installation of the hop-up rubber 6 within the chamber cavity 314, while the protrusion structure intensifies friction between the hop-up rubber 6 and projectiles. This facilitates improved projectile hop-up spin, elevating shooting accuracy and range.

Referring especially to FIGS. 10-15, radially extending limiting block (111) are disposed on the outer wall of the hop-up rubber 6, and both the chamber housing L 311 and chamber housing R 312 are provided with limiting slot (112) for embedding the limiting block (111). This configuration restricts axial movement of the hop-up rubber 6 within the chamber cavity 314, ensuring positional fixation. The engagement between the limiting block (111) and limiting slot (112) further enhances installation stability of the hop-up rubber 6, preventing displacement during operation. This guarantees consistent backspin effect and operational reliability.

Figure 12:
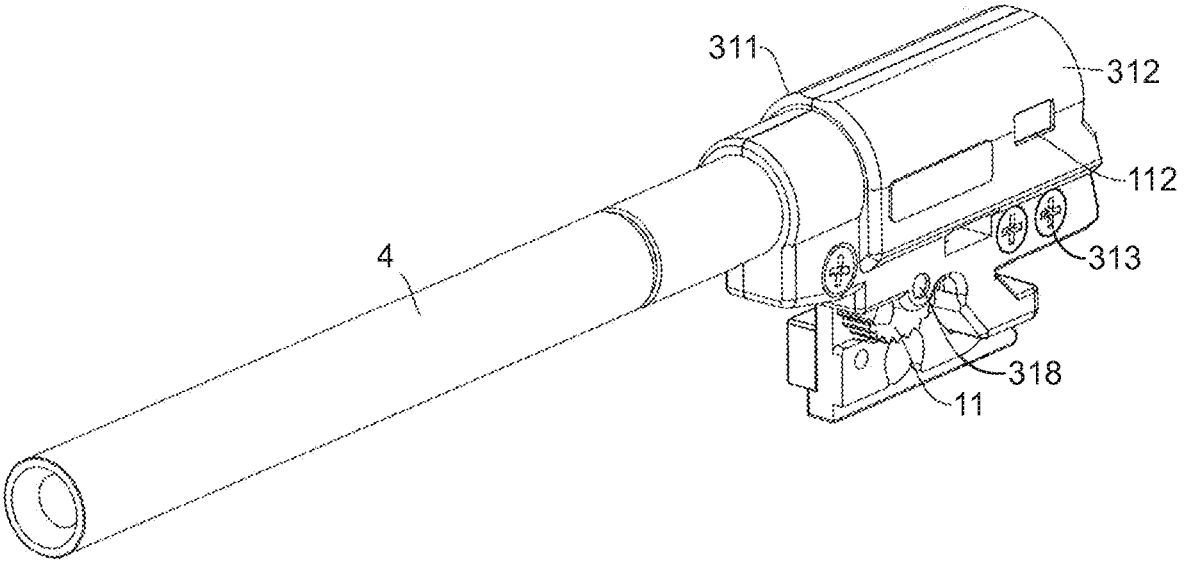
FIG. 12 is a front isometric view of the hop-up chamber in the air gun.

Referring especially to FIGS. 12 and 13, the chamber housing R 312 is provided with multiple housing screw 313 extending toward the chamber housing L 311. The inner sidewall of the chamber housing L 311 is provided with multiple threaded sleeves for the housing screw 313 to screw into. The housing screw 313 on the chamber housing R 312 engage with the threaded sleeves on the inner sidewall of the chamber housing L 311, thereby achieving a fastened connection between the chamber housing L 311 and chamber housing R 312. This bolted connection is simple and reliable, facilitating user installation and disassembly of the hop-up chamber 5. It enables maintenance, cleaning, and replacement of internal wearable components, resolving the problem of complex assembly/disassembly in prior art.

The hop-up chamber 5 comprises a chamber housing L 311 and a chamber housing R 312 configured to be assembled. Upon assembly, the housings collectively enclose a chamber cavity 314 that provides an installation space for adjustment components. A cylinder 7 connected to the rear end imparts initial kinetic energy to projectiles. Within the chamber cavity 314, the hop-up rubber 6 is externally sleeved with an adjustment ring 10. The adjustment ring 10 is dynamically controlled by a drive assembly, thereby regulating the compression degree of the hop-up rubber 6.

In the adjustment assembly, the adjustment dial 11 is rotatably mounted between the chamber housing L 311 and chamber housing R 312. Its concentric spiral groove 12 engages with a follower shaft of the adjustment lever 317 at the lower portion of the adjustment ring 10. When a user rotates the adjustment dial 11, the follower shaft moves along the spiral groove 12, driving the adjustment lever 317 and adjustment ring 10 to move vertically. As the adjustment lever 317 drives the adjustment ring 10 downward, the adjustment ring 10 compresses the hop-up rubber 6, thereby increasing the frictional contact force between the hop-up rubber 6 and projectiles. When the rubber applies friction to projectiles, the fired projectiles acquire backspin rotation. Due to the Magnus effect, a projectile with backspin rotation experiences a vertical lift force during flight through air. This lift counteracts gravitational drop, causing upward curvature of the trajectory, thereby extending the time-to-impact and increasing effective range. By stabilizing the backspin rotation of projectiles, the system reduces deviations induced by aerodynamic drag and crosswinds, ensuring consistent ballistic behavior. This enhances shooting accuracy through improved trajectory predictability.

To ensure stable rotation of the adjustment dial 11, a rotating shaft 318 is mounted between the chamber housing L 311 and chamber housing R 312, with the adjustment dial 11 rotatably installed thereon. The hop-up rubber 6 is secured within the chamber cavity 314 through tight adhesion between its outer wall and the inner wall of the chamber cavity 314, as well as through the cooperative engagement between the limiting block (111) and limiting slot (112). Protrusions on the inner wall of the hop-up rubber 6 enhance frictional contact with projectiles, allowing them to achieve optimal backspin rotation. Housing screw 313 on the chamber housing R 312 engage with threaded sleeves on the inner sidewall of the chamber housing L 311, achieving a fastened connection between the chamber housing L 311 and chamber housing R 312.

A pressurization structure for an air gun chamber, includes an inner barrel 4, sequentially connected at its rear end to a coaxially disposed hop-up rubber 6 and a cylinder 7. The hop-up rubber 6 is penetrated by a cavity allowing projectile 516 sliding, with a protrusion extending radially along the inner wall of the cavity to compress the projectile 516. The cylinder 7 includes a chamber communicating with the cavity, wherein a rubber piston 8 is installed to form a sealed chamber behind the projectile 516. A cut-off valve 9 is disposed within the sealed chamber. A magazine 14 is externally connected to the cylinder 7 for supplying gas and projectiles 516 into the chamber. Further, the cut-off valve 9 is located inside the cylinder 7 and is capable of sliding axially along the cylinder 7. Further, the chamber is configured as a stepped bore structure, comprising a large-diameter end and a small-diameter end; the rubber piston 8 is disposed at the large-diameter end of the chamber, while the cut-off valve 9 slides within the small-diameter end. Further, the cut-off valve 9 comprises a valve rod (41) slidably disposed within the small-diameter end; a plurality of valve vanes (42) are arranged on the outer wall of the valve rod (41); a valve head (43) is connected to the rear end of the valve rod (41); and gas passages (44) are formed between adjacent valve vanes (42) for gas flow. Further, each valve vane (42) extends radially from the valve rod (41), with its outer sidewall sealingly contacting the inner wall of the chamber; the plurality of valve vanes (42) are circumferentially arrayed around the outer wall of the valve rod (41). Further, an air inlet port is provided on the outer wall of the cylinder 7; the magazine 14 is equipped with a gasket 518 at its top end, which communicates with the air inlet port and achieves sealing via interference compression. Further, a projectile holding lip 18 is arranged on the sidewall of the magazine 14 to clamp the projectile 516; a projectile loading rod is disposed below the cylinder 7 to transfer the projectile 516 clamped by the projectile holding lip 18 into the chamber. Further, the front end of the cylinder 7 is inserted into a cavity of the hop-up rubber 6, with the outer wall of the cylinder 7 front end and the inner wall of the cavity forming an interference-fit seal.

The pre-pressure in the chamber enables the accumulation of a specific amount of energy within the cylinder 7, which is instantaneously released to convert the stored energy into kinetic energy for further accelerating the projectile 516. Consequently, the projectile 516 attains a higher muzzle velocity, allowing it to travel a greater distance per unit time, thereby effectively extending the effective range and enhancing ballistic stability.

Referring especially to FIGS. 16-20, an air gun includes a pressurization structure for an airgun chamber including an inner barrel 4, sequentially connected at its rear end to a coaxially disposed hop-up rubber 6 and a cylinder 7. The hop-up rubber 6 is penetrated by a cavity allowing projectile 516 sliding, with a protrusion extending radially along the inner wall of the cavity to compress the projectile 516. The cylinder 7 includes a chamber communicating with the cavity, wherein a rubber piston 8 is installed to form a sealed chamber behind the projectile 516. A cut-off valve 9 is disposed within the sealed chamber. A magazine 14 is externally connected to the cylinder 7 for supplying gas and projectiles 516 into the chamber. The magazine 14 supplies gas into the chamber and feeds projectiles 516 into the hop-up rubber 6. After the projectile 516 enters the cavity of the hop-up rubber 6, the protrusion inside the hop-up rubber 6 compresses the projectile 516, providing positioning and pre-compression sealing. The rubber piston 8 forms a sealed chamber with the cylinder 7, wherein the cut-off valve 9 is disposed. When gas enters the chamber, pressure builds within the sealed space, propelling the projectile 516 forward through the cavity of the hop-up rubber 6 and the inner barrel 4.

In prior art airgun structures, gas acts directly on the projectile 516, gradually converting the gas energy within the cylinder 7 into kinetic energy of the projectile through the barrel. When the barrel is short, the gas conversion time within the cylinder 7 is insufficient, resulting in significant energy wastage. In contrast, in the present design, the chamber pre-pressure enables the accumulation of a specific amount of energy inside the cylinder 7, which is instantaneously released to convert the stored energy into kinetic energy for further accelerating the projectile 516. Consequently, the projectile 516 attains a higher muzzle velocity, allowing it to travel a greater distance per unit time, thereby effectively extending the effective range and enhancing ballistic stability.

The air gun disclosed herein uses a sealed chamber system including: chamber sealing achieved through preset friction between the projectile 516 and hop-up rubber 6, enabling initial pressurization; rear sealing via a rubber piston 8 at the tail end of the cylinder 7; gas inlet sealing through interference-fit compression between the cylinder 7 and an gasket 518 mounted on the magazine 14; and front nozzle sealing by interference-fit between the outer wall of the cylinder 7 nozzle and the cavity of the hop-up rubber 6.

During firing, the magazine 14 releases gas into the chamber. When chamber pressure exceeds the frictional resistance between the projectile 516 and hop-up rubber 6, the cut-off valve 9 move forward to propel the projectile 516 into the hop-up rubber 6, subsequently releasing gas to further accelerate the projectile 516, thereby increasing the muzzle energy of the projectile 516. The improved structure can provide sufficient muzzle energy for projectiles 516 made of heavier materials such as steel balls, thereby enhancing their effective range and firing stability. At the connection position between the inner barrel 4 and the cylinder 7, the design incorporates sealing and reinforcement structures, which improve pneumatic efficiency and enable the system to withstand higher chamber pressures. This ensures reliability for each firing and extends the service life of the airgun. Verified by testing, the present design structure ensures that when firing 4.5 mm steel ball projectiles 516 using a 12 g $CO_2$ gas cartridge, the muzzle energy fluctuation range of the first 40 projectiles 516 is less than 10%, with a maximum range reaching 80 m. At a 30 m distance, the shooting accuracy achieves a circular dispersion pattern with a diameter of 30 cm.

Figure 19:
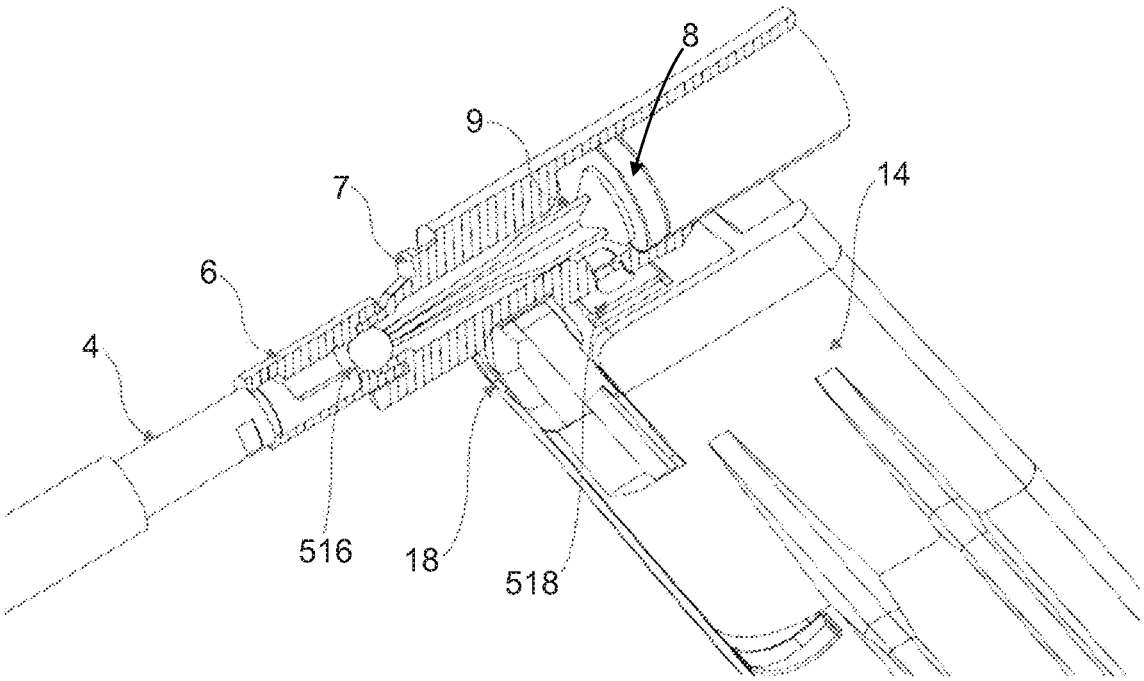
FIG. 19 is a cross-sectional view of the cylinder of the air gun.

Referring especially to FIG. 19, the cut-off valve 9 is disposed inside the cylinder 7 and is capable of sliding axially along the cylinder 7. The cut-off valve 9 can slide axially along the cylinder 7. After gas enters the sealed chamber, pressure variations drive the axial movement of the cut-off valve 9 within the cylinder 7, thereby altering the gas flow path and switching the sealing state of the chamber. This mechanism further controls the propulsion effect on the projectile 516.

Referring to FIG. 19, the chamber features a stepped bore structure comprising a large-diameter end and a small-diameter end. The rubber piston 8 is disposed at the large-diameter end of the chamber, while the cut-off valve 9 is slidably mounted in the small-diameter end of the chamber. With the chamber configured as a stepped bore structure, the rubber piston 8 is positioned at the large-diameter end. When gas enters the chamber, the large-diameter end provides ample space to accommodate gas accumulation and the movement of the rubber piston 8. The cut-off valve 9 slides within the small-diameter end; as gas pressure varies, the axial movement of the cut-off valve 9 regulates gas discharge and the sealing state of the chamber, thereby ensuring the projectile 516 is propelled under optimal pressure conditions.

Figure 20:
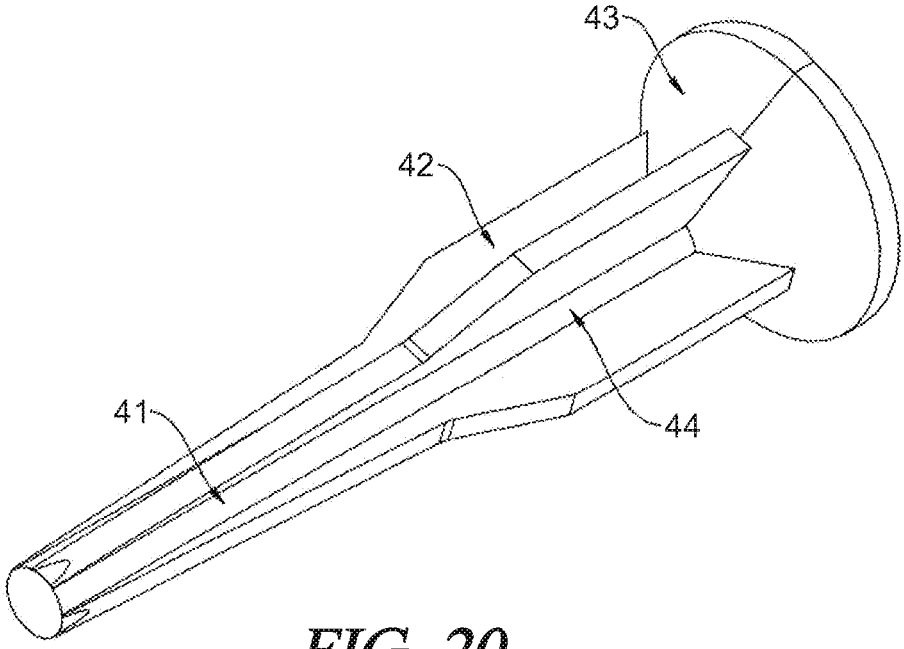
FIG. 20 is a isometric view of the cut-off valve 9 in the air gun.
Figure 21:
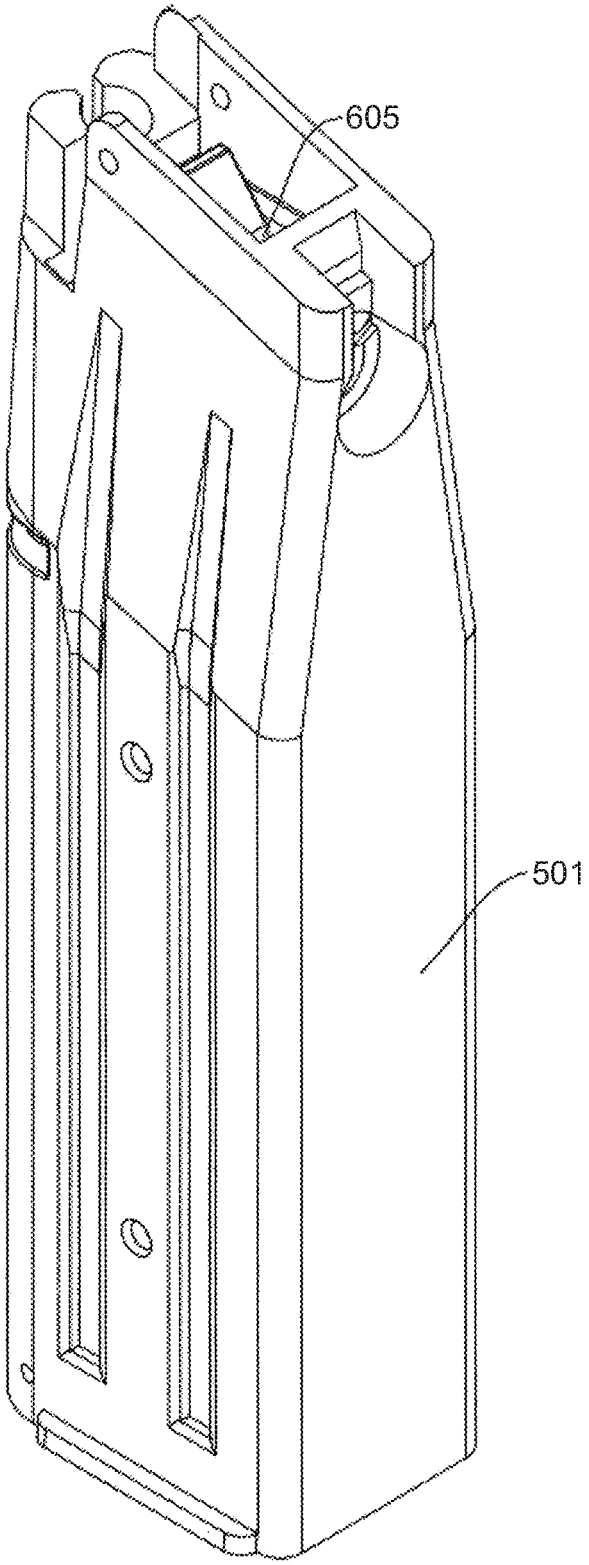
FIG. 21 is an isometric view of the magazine of the air gun.
Figure 22:
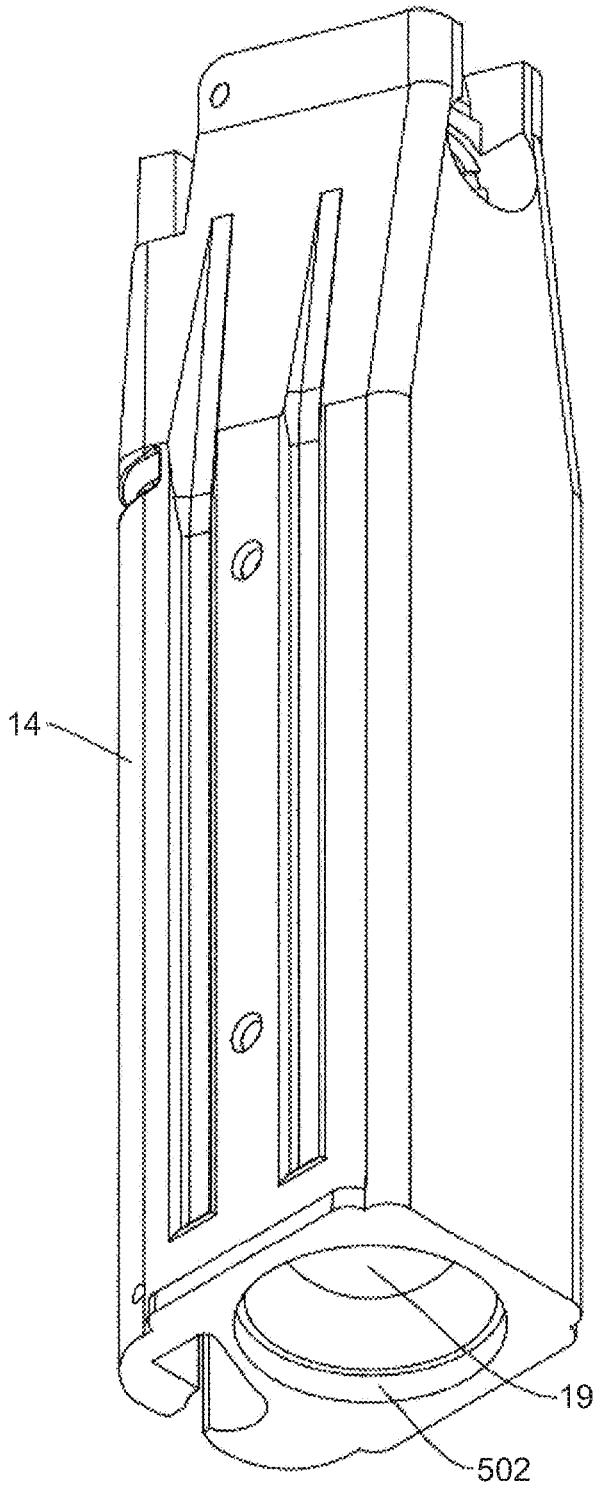
FIG. 22 is a bottom view structural schematic diagram of the magazine.
Figure 23:
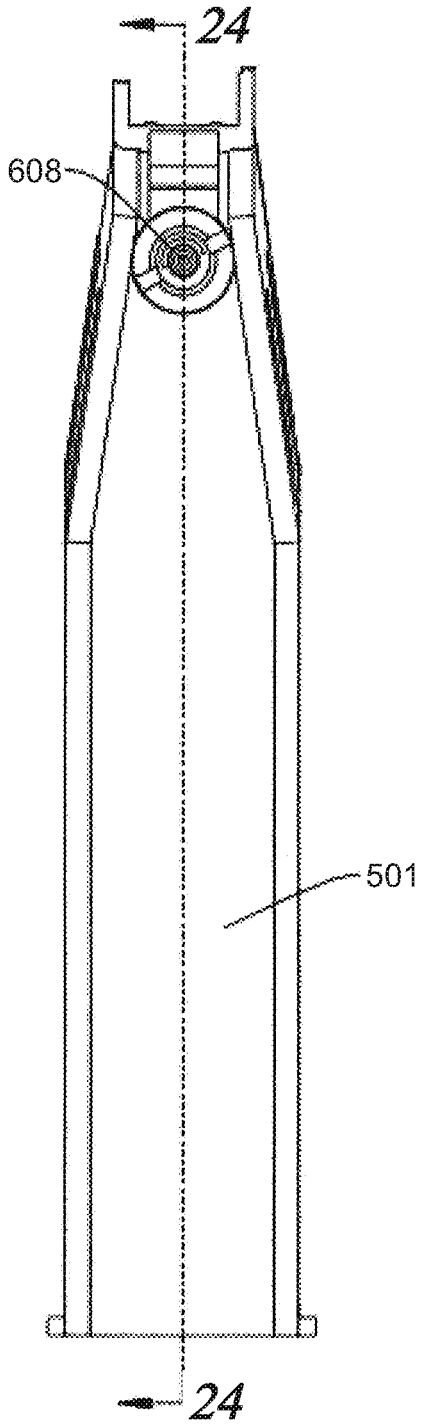
FIG. 23 is a rear view structural schematic diagram of the magazine.

Referring especially to FIGS. 19 and 20, the cut-off valve 9 comprises a valve rod (41) slidably disposed within the small-diameter end of the chamber. A plurality of valve vanes (42) are radially arranged on the outer wall of the valve rod (41), and a valve head (43) is disposed at the rear end of the valve rod (41). Gas passages (44) are formed between adjacent valve vanes (42) to enable gas flow. The valve vanes (42) extend radially from the valve rod (41), with their outer sidewalls in close contact with the inner wall of the chamber. Multiple valve vanes (42) are circumferentially distributed at equal angles around the cylindrical periphery of the valve rod (41). Specifically, the valve vanes (42) provide centering and stabilization during axial sliding of the cut-off valve 9 within the cylinder 7. Simultaneously, the tight contact between the valve vanes (42) and the chamber inner wall enhances gas sealing to prevent leakage. The equidistant angular distribution of valve vanes (42) uniformly regulates gas flow through the gas passages (44), ensuring balanced force distribution on the valve rod (41) and valve head (43) during sliding. This design guarantees stable operation of the cut-off valve 9.

Referring to FIG. 19, an air inlet is disposed on the outer wall of the bottom end of the cylinder 7. The top end of the magazine 14 is provided with a gasket 518 in fluid communication with the air inlet. The gasket 518 and the air inlet form a seal through interference fit compression. Specifically, during gas supply, gas from the magazine 14 enters the air inlet of the cylinder 7 through the gasket 518. The interference fit compression prevents gas leakage during intake, ensuring unimpeded gas flow into the chamber and reliable initiation of the firing sequence.

Referring to FIG. 19, the front side of the magazine 14 is provided with a projectile holding lip 18 that securely holds the projectile 516. A loading rod is disposed below the cylinder 7 to push the projectile 516 gripped by the projectile holding lip 18 into the hop-up rubber. Specifically, the projectile holding lip 18 on the front side of the magazine 14 immobilizes the projectile 516, preventing unintended movement within the magazine 14. During firing, the loading rod below the cylinder 7 propels the projectile 516 from the projectile holding lip 18 into the hop-up rubber. Compressed gas then enters the hop-up rubber cavity to propel the projectile 516 outward. The projectile holding lip 18 ensures precise positioning of the projectile 516 in the magazine 14, enabling the loading rod to accurately transfer the projectile 516 to the hop-up rubber. This design enhances feeding accuracy and reliability, reduces deviations during ammunition supply, guarantees cycling continuity and stability of the airgun, and improves overall performance.

Referring to FIG. 19, the front end of the cylinder 7 is inserted into the cavity of the hop-up rubber 6, with an interference fit formed between the outer wall of the cylinder front end and the inner wall of the cavity to achieve sealing.

Initial Preparation State: The magazine 14 stores a predetermined volume of gas released from a gas canister The airgun is in a ready-to-fire condition. The projectile holding lip 18 on the front sidewall of the magazine 14 securely holds a projectile 516, providing positional fixation and immobilization. A loading rod below the cylinder 7 propels the projectile 516 from the projectile holding lip 18 into the hop-up rubber 6. At this stage, the cavity of the hop-up rubber 6 clamps the projectile 516 and the front nozzle of the cylinder 7 via pre-compression, thereby forming a relatively sealed space between the rear of the projectile 516 and the interior of the cylinder 7. This configuration prevents gas leakage and prepares for subsequent pressurization.

Triggering and Pressurization Stage: When the shooter pulls the trigger, the gas-release system of the airgun is actuated. Gas is released from the magazine 14, enters the cylinder 7 through a specific channel via the junction between the gasket 518 and the air inlet of the cylinder 7. As gas continuously flows into the sealed cavity between the projectile 516 and the cylinder 7, the internal pressure gradually rises. Due to the pre-compression force exerted by the cavity and the protrusion of the hop-up rubber 6 against the projectile 516, the projectile 516 remains stationary prior to reaching a threshold pressure. The sealed cavity undergoes continuous pressurization, resulting in a further pressure increase.

Projectile Launching Stage: When the pressure in the chamber of the cylinder 7 exceeds the pre-compression force exerted by the hop-up rubber 6 on the projectile 516, the cut-off valve 9 is actuated. Driven by gas pressure, the cut-off valve 9 moves axially forward along the cylinder 7, thereby propelling the projectile 516 into the cavity of the hop-up rubber 6. Consequently, the originally sealed cavity is opened, releasing the pressurized gas. The high-pressure gas acts on the projectile 516, imparting forward thrust to accelerate the projectile 516 through the inner barrel 4. The inner wall of the hop-up rubber 6 is provided with a depression protrusion. When the projectile 516 is launched and passes through the hop-up rubber 6, the depression protrusion imparts backspin to the projectile 516, thereby endowing it with rotational motion. This rotation significantly enhances the flight stability of the projectile 516, reduces ballistic disturbance, and improves shooting accuracy.

A magazine for an air gun includes a magazine housing. Inside the magazine housing, from top to bottom, are sequentially and communicatively arranged: an exhaust port, an exhaust chamber, a secondary buffer gas chamber, and an intake chamber. An intake component is arranged within the intake chamber, and an exhaust component is arranged within the exhaust chamber. The intake component includes an intake base that is sealed and installed within the intake chamber. The intake base is provided with an air outlet that communicates with the secondary buffer gas chamber. The bottom surface of the intake base is also provided with a gas inlet for delivering compressed gas to the gas outlet. A gas canister is connected to the interior of the gas inlet. Further, the outer wall of the intake base fits closely against the inner wall of the intake chamber, and an annular groove is formed on the outer wall of the intake base, within which a first sealing ring is installed. Further, a gas nozzle is provided on the inner wall of the gas inlet, and the interior of the gas nozzle includes a gas passage that communicates the gas outlet with the gas inlet. Further, the gas canister is filled with liquid $CO_2$, and the port of the high-pressure gas canister is sleeved over the outside of the gas nozzle. Further, the exhaust component includes an exhaust base sealed and installed inside the exhaust chamber, with exhaust holes formed through the wall surface of the exhaust base that communicate with the exhaust port; a valve is slidably arranged within the cavity, and the valve slides to open or close one end of the exhaust base. The valve comprises a trigger rod disposed inside the cavity, the trigger rod being axially slidable within the exhaust base, and one end of the trigger rod is connected to a valve head that is capable of sealing the end port of the exhaust base. Further, a plurality of exhaust holes are provided, and the exhaust holes are arranged in a circumferential array on the wall surface of the exhaust base. Further, the outer wall of the exhaust base fits closely against the inner wall of the exhaust chamber, and a sealing ring is mounted on the outer wall of the exhaust base. Further, an embedding groove is formed on the open end face of one end of the exhaust base, and a second sealing ring is installed within the embedding groove.

The air gun introduces a secondary buffer gas chamber between the intake chamber and the exhaust chamber, allowing the liquid $CO_2$ from the gas canister to fully vaporize, expand, and stabilize before entering the working cycle, ensuring that the gas is in a gaseous state during exhaust. This effectively increases gas pressure, significantly improves pressure stability, enhances the muzzle velocity of the projectile and the consistency of each firing cycle, and increases the number of effective shots per unit of gas. At the same time, it improves the stability of the thrust applied to the projectile, thereby enhancing shooting accuracy. The air gun has a first sealing ring and a second sealing ring at the intake base and exhaust base effectively prevent gas leakage, ensuring stable vaporization pressure of the gas and providing a consistent power source for projectile shooting. The use of a gas canister supplies sufficient compressed gas, ensuring that adequate propulsion is maintained during continuous firing and reducing performance degradation caused by insufficient gas.

Referring especially to FIGS. 21 to 29, the utility patent provides a technical solution: a magazine for an air gun, comprising a magazine housing 501, wherein the magazine housing 501 is provided with an exhaust port 605, an exhaust chamber 503, a secondary buffer gas chamber 21 and an intake chamber 502 which are interconnected from top to bottom, an intake component 606 is provided inside the intake chamber 502, and an exhaust component 608 is provided inside the exhaust chamber 503. The intake component 606 comprises an intake base (61) which is sealed and installed inside the intake chamber 502. The intake base (61) has a gas outlet (64) which is connected to the secondary buffer gas chamber 21. The bottom surface of the intake base (61) is also provided with a gas inlet (65) for conveying compressed gas to the inside of the gas outlet (64). A gas canister 19 is connected inside the gas inlet (65). The exhaust component 608 includes an exhaust base (81) sealed within the exhaust chamber 503. The wall of the exhaust base (81) is perforated with exhaust hole (83) connected to the exhaust port 605. A valve is slidably disposed inside the cavity, moving to open/close one end of the exhaust base (81). The valve consists of a trigger rod (85) positioned within the cavity. The trigger rod (85) can slide axially along the exhaust base (81). One end of the trigger rod (85) is connected to a valve head (86) which can block the orifice at one end of the exhaust base (81). Specifically, the liquid $CO_2$ within the gas canister 19 enters the gas inlet (65) of the intake component 606, flows through the intake base (61), and proceeds to the secondary buffer gas chamber 21 via the gas outlet (64). It then advances into the exhaust chamber 503. When firing is required, the valve member of the exhaust component 608 slides to open the orifice at one end of the exhaust base (81). This allows the compressed gas in the exhaust chamber 503 to pass through the cavity of the exhaust base (81), exit via the exhaust holes (83), and finally discharge from the exhaust port 605 to propel the projectile.

This configuration interconnects the exhaust port 605, exhaust chamber 503, secondary buffer gas chamber 21, and intake chamber 502, coordinated with the intake component 606 and exhaust component 608. By incorporating a secondary buffer gas chamber 21 between the liquid $CO_2$ supply and the exhaust mechanism, the liquid $CO_2$ from the gas canister 19 undergoes gasification, expansion, and pressure stabilization within the secondary chamber. As a result, when released by the exhaust component 608, the $CO_2$ exists in a gaseous state. This significantly enhances gas pressure, increases projectile muzzle velocity, and stabilizes energy output per cycle. Consequently, the number of effective shots per unit gas volume rises, improves uniformity of gas flow within the magazine, and ensures consistent thrust during projectile acceleration thereby boosting shooting accuracy.

Figure 25:
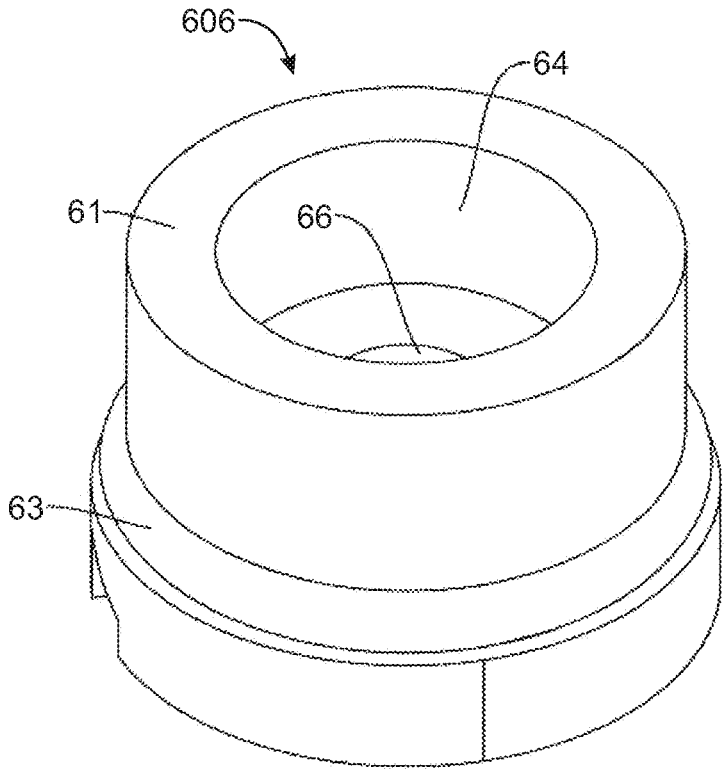
FIG. 25 is an isometric view of the intake component in the magazine.

As shown in FIG. 25, the outer wall of the intake base (61) fits closely against the inner wall of the intake chamber 502. The intake base (61) features an annular groove (62) on its outer wall, housing the first sealing ring (63). The first sealing ring (63) installed in the annular groove (62) fills microscopic gaps between the intake base (61) and the inner wall of the intake chamber 502. This prevents leakage of compressed gas from the joint between the intake base (61) and the intake chamber 502. The effective sealing ensures that all compressed gas entering the intake base (61) flows through the gas outlet (64) into the secondary buffer gas chamber 21, avoiding pressure loss due to gas leakage. Consequently, it improves the utilization efficiency of compressed gas and further ensures stable power output for projectile propulsion.

Figure 26:
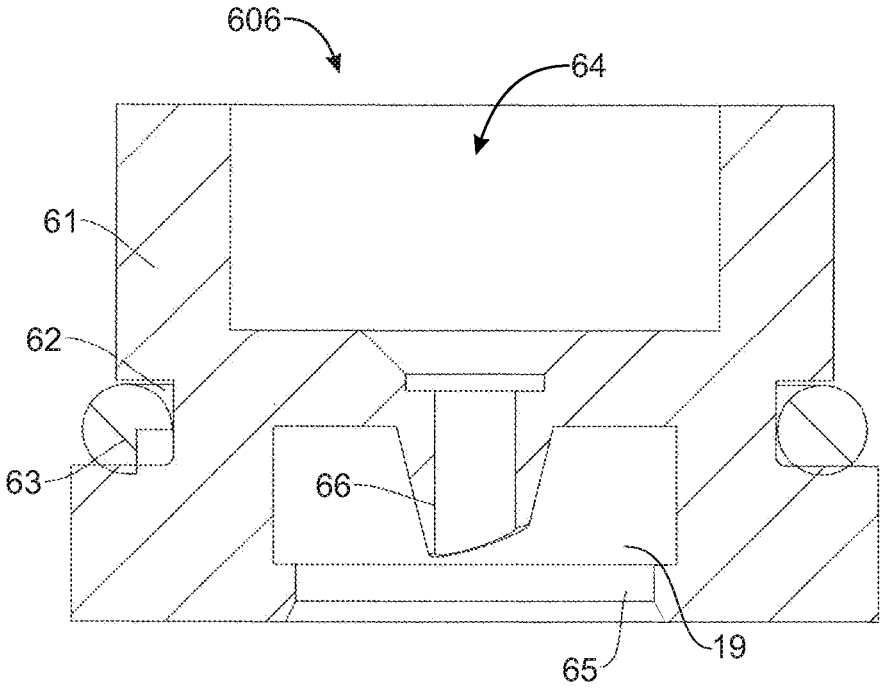
FIG. 26 is a sectional view of the intake component in the magazine.

Referring to FIG. 26, a gas nozzle (66) is mounted on the inner wall of the gas inlet (65). The gas nozzle (66) contains a gas passage connecting the gas outlet (64) and the gas inlet (65). The gas nozzle (66) guides and regulates gas flow, enabling gas to enter the intake base (61) more smoothly. By optimizing the gas entry path, this configuration reduces flow resistance and turbulence during gas ingress into the intake base (61), thereby enhancing gas entry efficiency and stability. Consequently, it provides a stable power source for subsequent firing process.

Figure 24:
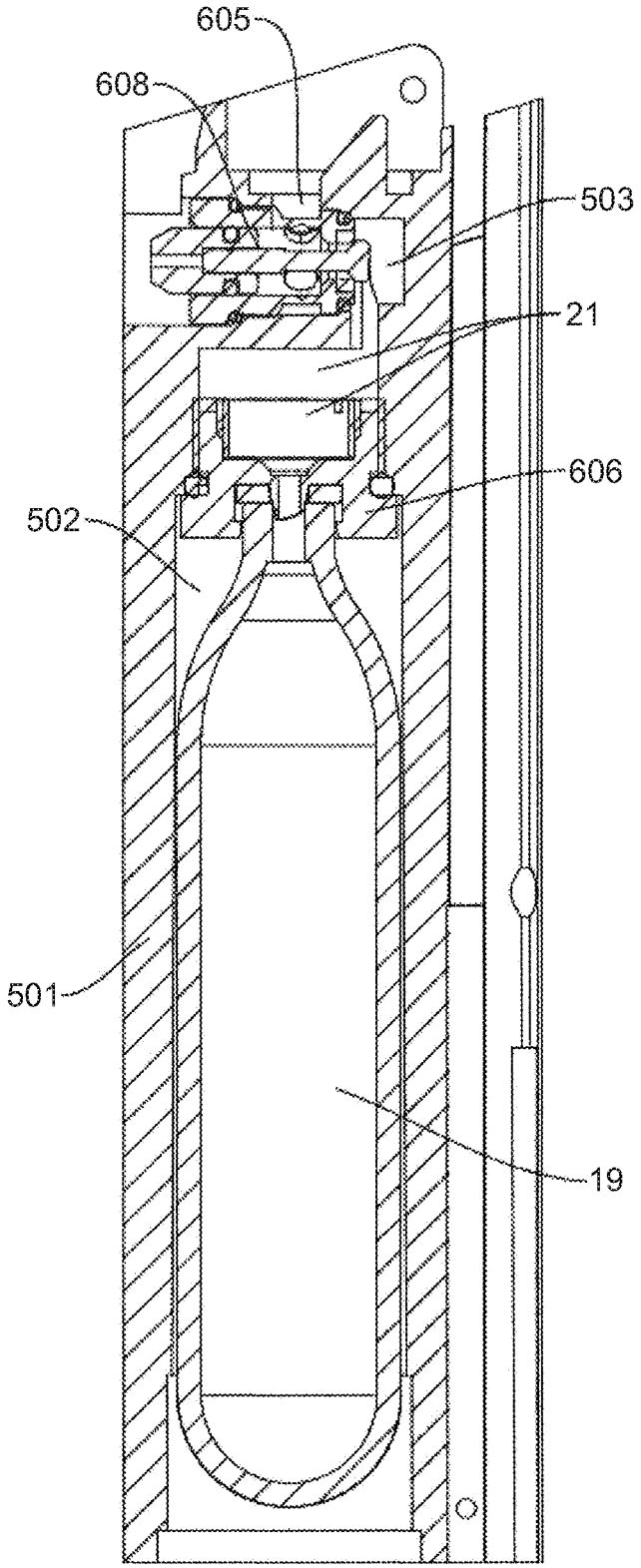
FIG. 24 is a sectional view taken along section line A-A in FIG. 23.

Referring to FIG. 24, the gas canister 19 is filled with liquid $CO_2$. The port of the gas canister 19 is sleeved over the exterior of the gas nozzle (66). The gas within the gas canister 19 flows through the gas passage of the gas nozzle (66) and enters the gas outlet (64) of the intake base (61). This process provides a sufficient power source for the entire magazine's gas supply system.

Figure 28:
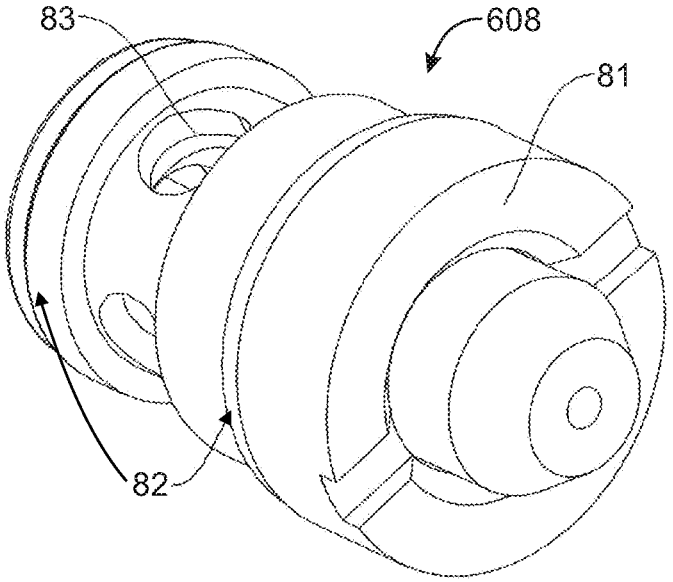
FIG. 28 is a rear view of the exhaust component in the magazine.
Figure 29:
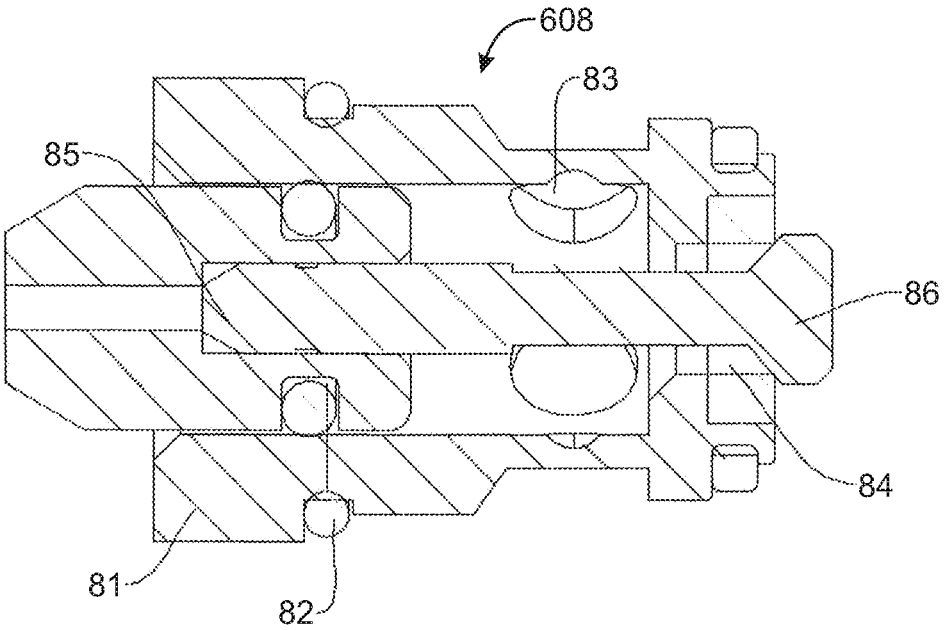
FIG. 29 is a sectional view of the exhaust component in the air gun.

Referring to FIG. 29, the valve comprises a trigger rod (85) positioned within the cavity. The trigger rod (85) is capable of sliding axially along the exhaust base (81), with one end connected to a valve head (86) that can seal the port at one end of the exhaust base (81). The trigger rod (85) is capable of sliding axially along the exhaust base (81). When the trigger rod (85) slides, it drives the valve head (86) to move. During projectile firing, the trigger rod (85) moves to disengage the valve head (86) from the port at one end of the exhaust base (81), thereby opening the aperture of the exhaust base (81) and releasing gas. After firing, the trigger rod (85) resets, causing the valve head (86) to seal the port of the exhaust base (81) and prevent further gas discharge. By utilizing the sliding motion of the valve assembly to open and close the aperture at one end of the exhaust base (81), this mechanism achieves precise control over the timing and flow rate of gas release, enabling effective regulation of projectile propulsion. This controlled exhaust method enhances shooting accuracy and stability, mitigating firing errors caused by uncontrolled gas discharge Referring to FIG. 27, a plurality of exhaust holes (83) are arranged in a circumferential array on the wall surface of the exhaust base (81). The configuration of multiple exhaust holes (83) enables compressed gas to rapidly discharge from the exhaust port 605. Referring to FIG. 28, the outer wall of the exhaust base (81) is fitted to the inner wall of the exhaust chamber 503 with a sealing ring (82) mounted on the outer wall of the exhaust base (81). The sealing ring (82) fills the gap between the exhaust base (81) and the inner wall of the exhaust chamber 503, preventing compressed gas leakage from the junction. The sealing ring (82) ensures hermetic sealing between the exhaust base (81) and the exhaust chamber 503, thereby confining the gas flow exclusively through the cavity of the exhaust base (81) and the exhaust holes (83). This design avoids pressure loss and airflow turbulence caused by gas leakage, guarantees stable and effective gas discharge, and consequently enhances firing performance.

Figure 27:
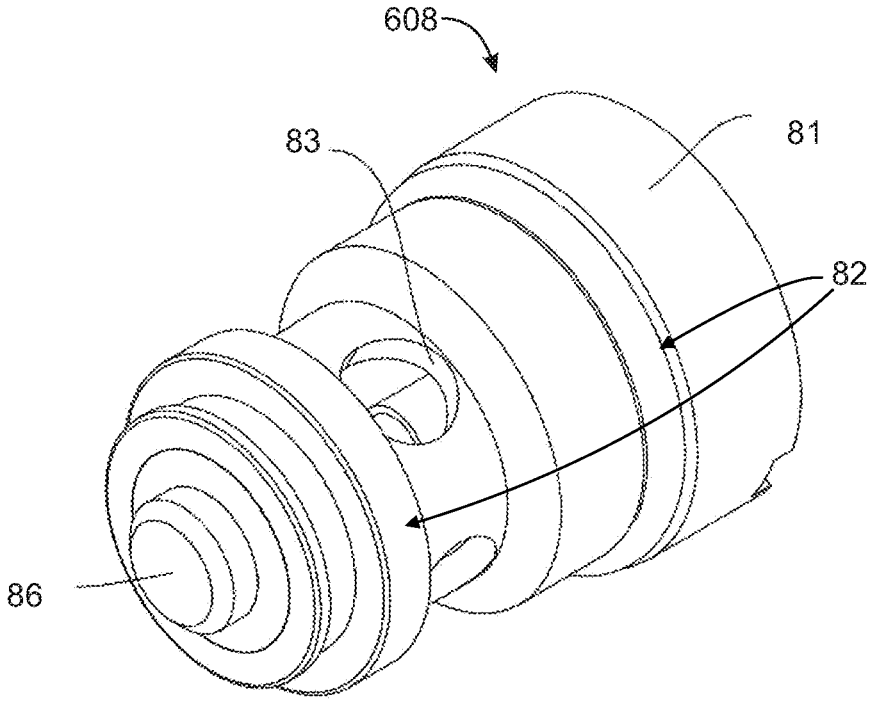
FIG. 27 is a front view of the exhaust component in the magazine.

Referring especially to FIGS. 27 and 29, an embedding groove is provided on the end face of the open port of the exhaust base (81) with a second sealing ring (84) installed inside the embedding groove. When the valve head (86) seals the port of the exhaust base (81), the second sealing ring (84) serves buffering and sealing functions, enhancing the sealing effect. The configuration of the second sealing ring (84) improves the sealing integrity during port closure, prevents gas leakage during non-firing states, and simultaneously reduces collision and wear between the valve head (86) and the port of the exhaust base (81). This design extends the service life of components and ensures the stability and reliability of the entire gas intake/exhaust system.

The gas canister 19 serves as an independent storage device for liquid $CO_2$. Its port is sleeved over the gas nozzle (66) of the intake component 606. When the air gun is prepared for firing, liquid $CO_2$ from the gas canister 19 flows through the internal gas passage of the gas nozzle (66) and enters the intake base (61) via the gas inlet (65). The gas entering the intake base (61) then flows through the gas outlet (64) into the secondary buffer gas chamber 21. The first sealing ring (63) installed in the annular groove (62) on the outer wall of the intake base (61) effectively prevents gas leakage at the junction between the intake base (61) and the inner wall of the intake chamber 502, ensuring all compressed gas enters the secondary buffer gas chamber 21. The gas accumulates in the gas flow channel and secondary buffer gas chamber 21, awaiting the firing command. At this stage, the valve assembly of the exhaust component 608 remains closed, with the valve head (86) sealing the port of the exhaust base (81). The sealing ring (82) on the outer wall of the exhaust base (81) maintains hermetic sealing between the exhaust base (81) and the exhaust chamber 503, preventing gas leakage.

Upon pulling the trigger to initiate firing, the trigger rod (85) slides axially along the exhaust base (81), driving the valve head (86) away from the port of the exhaust base (81) to open the aperture. The accumulated compressed gas in the gas flow channel and secondary buffer gas chamber 21 then enters the cavity within the exhaust base (81) and discharges through the exhaust port 605. This released gas acts on the projectile, providing propulsion force.

After firing, continuous gas flow through the secondary buffer gas chamber 21 into the exhaust chamber 503 drives the valve head (86) and trigger rod (85) to automatically reset. The valve head (86) reseals the port of the exhaust base (81), with the second sealing ring (84) in the embedding groove of the port enhancing sealing integrity to prevent gas leakage, thereby preparing the system for the next firing cycle.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. An air gun comprising:

a hop up rubber configured to receive a projectile and seal about the projectile;

a cylinder sealed to the hop up rubber and in fluid communication with the hop up rubber, said cylinder configured to receive pressurized gas from a magazine of the air gun in response to input received at a trigger of the air gun; and a cut off valve in the cylinder comprising a valve head, a valve rod forward of the valve head and having a smaller diameter than the valve head, and a plurality of valve vanes extending outwardly from the valve rod toward walls of the cylinder;

wherein the cutoff valve is configured to move the projectile forward when pressure inside the cylinder exceeds a resistance between the projectile and the hop up rubber.

2. The air gun of claim 1, wherein:

the air gun further comprise a gun body supporting the hop up rubber, cylinder, and trigger;

the air gun further comprises the magazine; and the magazine contains a compressed gas canister and is detachable from a gun body of the air gun.

3. The air gun of claim 1, wherein:

the air gun further comprise a gun body supporting the hop up rubber, cylinder, and trigger;

the air gun further comprises the magazine;

the magazine contains a compressed gas canister and is detachable from a gun body of the air gun; and the magazine comprises an outlet valve configured to provide compressed gas from the compressed gas canister to the cylinder in response to the input received at the trigger of the air gun.

4. The air gun of claim 1, wherein:

the valve vanes contact the cylinder toward a rear of the cutoff valve; and the valve vanes do not contact the cylinder toward a front of the cutoff valve.

5. The air gun of claim 1, wherein:

the hop up rubber further comprises a protrusion extending downward from a top of the hop up rubber such that the hop up rubber imparts backspin to the projectile when the projectile is expelled from the hop up rubber by the cutoff valve and pressurized gas in the cylinder.

6. The air gun of claim 1, wherein:

the air gun further comprises an inner barrel configured to receive the projectile and compressed gas from the hop up rubber.

7. The air gun of claim 1, wherein:

the air gun further comprises the trigger, said trigger configured to receive input from a user to discharge the air gun.

8. The air gun of claim 1, wherein:

the air gun further comprises a rubber piston, said rubber piston sealing a rear of the cylinder.

9. The air gun of claim 1, wherein:

the air gun further comprises a rubber piston, said rubber piston sealing a rear of the cylinder;

the rubber piston comprises a sealing ring; and the valve head seats against the sealing ring prior to discharge of the air gun.

10. The air gun of claim 1, wherein:

the air gun further comprises a rubber piston, said rubber piston sealing a rear of the cylinder;

the rubber piston comprises a sealing ring;

the valve head seats against the sealing ring prior to discharge of the air gun; and the rubber piston further comprises a locking bolt extending forward through the sealing ring.

11. The air gun of claim 1, wherein:

the air gun further comprises a rubber piston, said rubber piston sealing a rear of the cylinder;

the rubber piston comprises a sealing ring;

the valve head seats against the sealing ring prior to discharge of the air gun;

the rubber piston further comprises a locking bolt extending forward through the sealing ring;

the rubber piston further comprises a plug; and the locking bolt extends rearward through the plug.

* * * * *